US005176987A

United States Patent [19]

Nakamura et al.

[11] Patent Number: 5,176,987

[45] Date of Patent: Jan. 5, 1993

[54] METHOD FOR PROCESSING SILVER HALIDE COLOR PHOTOGRAPHIC MATERIALS

[75] Inventors: Koichi Nakamura; Nobutaka Ohki, both of Kanagawa, Japan

[73] Assignee: Fuji Photo Film Co., Ltd., Kanagawa, Japan

[21] Appl. No.: 776,851

[22] Filed: Oct. 16, 1991

Related U.S. Application Data

[63] Continuation of Ser. No. 558,542, Jul. 27, 1990, abandoned.

[30] Foreign Application Priority Data

Jul. 28, 1989 [JP] Japan ..... 1-196026
Apr. 3, 1990 [JP] Japan ..... 2-88825

[51] Int. Cl.[5] ..... G03C 7/30

[52] U.S. Cl. ..... 430/351; 430/376; 430/380; 430/467; 430/387; 430/484; 430/963

[58] Field of Search ..... 430/376, 380, 442, 467, 430/484, 963, 351, 387, 386

[56] References Cited

U.S. PATENT DOCUMENTS 4,738,917 4/1988 Kobashi et al. ..... 430/484
4,898,807 2/1990 Kobayashi et al. ..... 430/467
4,923,783 5/1990 Kobayashi et al. ..... 430/546

FOREIGN PATENT DOCUMENTS 0202616 11/1986 European Pat. Off. .
0269740 6/1988 European Pat. Off. .
2038497 7/1980 United Kingdom .

*Primary Examiner*—Richard L. Schilling
*Attorney, Agent, or Firm*—Sughrue, Mion, Zinn, Macpeak & Seas

[57] ABSTRACT

A method for processing an imagewise exposed color photographic material using fast developing time while maintaining stable processing conditions, reduced developer replenishing, and light fastness of developed color images. The method comprises developing a color photographic material containing silver halide grains comprising (i) substantially no silver iodide and (ii) at least about 80 mol % silver chloride with a developer comprising (i) substantially no benzyl alcohol and (ii) a p-phenylenediamine derivative represented by the formula (I):

(I)

wherein $R^1$ and $R^2$ each represents an alkyl group having from 1 to 4 carbon atoms and $R^2$ represents a straight chain or branched alkylene group having 3 or 4 carbon atoms and wherein the developing is for a period of time of less than 30 seconds.

12 Claims, No Drawings

METHOD FOR PROCESSING SILVER HALIDE COLOR PHOTOGRAPHIC MATERIALS

This is a continuation of application Ser. No. 07/558,542 filed Jul. 27, 1990, now abandoned.

FIELD OF THE INVENTION

The present invention relates to a process for developing a color photographic light-sensitive material comprising photosensitive silver halides and color couplers (e.g., color photographic papers). More particularly, the present invention relates to a fast color development process suitable for stable processing and capable of giving images having a high color image stability.

BACKGROUND OF THE INVENTION

Processing for silver halide color photographic materials comprises three basic steps including developing (in the case of the development for color reversal materials, a black-and-white (or first) development is employed before color development), desilvering, and washing. The desilvering step is composed of a bleach step and a fixing step or a monobath bleach-fixing ("blix") step which includes both bleaching and fixing.

In addition to the aforesaid steps, additional processing steps can be used, such as a stabilizing step, a prebath processing step before each processing step and a stop-bath processing step can be employed as is determined to be most suitable.

During color development, exposed silver halides present in imagewise exposed photographic material are reduced by a color developing agent to form silver and halide ions, and the resulting oxidized color developing agent simultaneously reacts with color couplers to form dyes. Accordingly, when many silver halide color photographic materials are continuously processed using an automatic processor or other continuous processing equipment, halide ions accumulate in the developer, thus rendering the developer unsuitable for further use.

Recently, in order to save natural resources and to help reduce environmental pollution, attempts have been made to reduce the amount of replenishers used with developers and other photographic processing solutions. However, an attempted resolution to this problem, e.g., by simply reducing the amount of replenisher used in a developer, encounters problems such as reduction in the developing activity of the developer due to the accumulation of other materials that dissolve out of photographic light-sensitive materials during processing. Such materials can include accumulated iodide and bromide ions, which are particularly strong development inhibitors, whose presence results in longer and unpredictable development times.

As another possible solution to the problem of excessive use of replenisher, there is a method of using less developer replenisher by increasing the pH and the processing temperature of the developer. However, such a method suffers from the problem that the photographic performance is highly variable during continuous processing and, additionally, the stability of the developer is reduced.

Also, another method for decreasing development times by reducing the accumulation of iodide ions or bromide ions utilizes a silver halide photographic material having a high silver chloride content, e.g., as disclosed in JP-A-58-95345, JP-A-59-232342 and JP-A-61-70552 (the term "JP-A" as used herein refers to a "published unexamined Japanese patent application") and WO 87-04534, and this method is considered to be an effective means of enabling fast processing with low amounts of replenisher used with the developer.

However, the aforesaid method suffers from the problem of difficulty in attaining very fast processing times (e.g., within 30 seconds) while maintaining stable color development and ensuring stable photographic developing during continuous processing using conventional color developing agents, such as, e.g., 4-amino-3-methyl-N-ethyl-N-β-methanesulfonamidoethylaniline salt. In particular, it has been found that when silver halide photographic materials (e.g., having a high silver chloride content) are processed at high pH or a high processing temperature, the processing speed can be increased, but the resulting stability of both the processing solution and that of the developed photographic material are so reduced as to render this method of processing unsuitable for any practical or commercial use.

Additionally, JP-A-61-261740 and JP-A-61-275837 disclose the use of N-hydroxyalkyl-substituted p-phenylenediamine derivatives as a color developing agent, in order to inhibit undesirable variation in the photographic performance, due to the presence of accumulated bromide ion, when silver halide photographic materials are developed that comprise silver halides having mostly silver chlorobromide. The specifications cited above describe improvement of storage stability of formed color images by carrying out the color development in a short time in order to reduce the amount of the color developing agent remaining in the silver halide photographic materials.

Also, it is said that in the case of using a hydroxyalkyl-substituted p-phenylenediamine derivative, used as a color developing agent for developing color photographic papers, the storage stability, and in particular, the fastness to light of the color images obtained is greatly reduced. But it has been found that when a color photographic light-sensitive material (paper) having a silver halide emulsion layers containing at least 80 mol % silver chloride is processed by a color developer containing a 4-amino-3-methyl-N-ethyl-N-β-hydroxyethylaniline salt, which is used as a color developing agent for conventional color photographic negative films and not containing benzyl alcohol, color images are formed fast (within 30 seconds) and the processing stability is excellent.

However, this method suffers from the problem that the fastness of the color images is greatly inferior to the case of using a 4-amino-3-methyl-N-ethyl-N-β-methanesulfonamidoethylaniline salt in spite of processing in a short period of time. British Patent 807,899 discloses that the use of certain N-hydroxyalkyl substituted p-phenylenediamine derivatives provides excellent storage stability of cyan color images. However, with a conventional processing time containing a long color developing time, the storage stability of yellow color images and magenta color images are poor and the stored images greatly deteriorated the color balance and could not be worthy of appreciation.

The storage stability of color images is generally an important factor for print materials such as color paper, and hence 4-amino-3-methyl-N-ethyl-N-β-methanesulfonamidoethylaniline salts have been used as the best compound.

At present, it has been a long-standing problem in this art to provide a commercially or practically suitable process that can reduce the amount of replenishers needed and, at the same time, reduce the processing and/or development time. However, as described above, previous attempts to provide such a process have failed, due to the occurrence of undesirable additional problems, including, e.g., reduced storage stability and reduced light fastness of color images formed on a developed photographic material.

For example, since the color images of developed photographic materials formed, using the aforesaid 4-amino-3-methyl-N-ethyl-N-β-hydroxyethylaniline salt (which is a color developing agent for developing color photographic negative films), at present are greatly reduced, the aforesaid color developing agent is practically unsuitable for developing color photographic papers.

In general, the rate of color development varies according to which type p-phenylenediamine derivative is used as a component of the developing agent. For example, a color developing agent having a hydrophobic group at the N-substituted position, such as a 4-amino-3-methyl-N,N-diethylaniline salt and a 4-amino-3-methyl-N-ethyl-N-methoxyethylaniline salt, is readily distributed with a coupler or other developer components into an oil drop phase of a photographic material, in order to increase the rate of developing reactions. Thus, such a color developing agent has been used for faster development. Examples of such developing agents and how they are made are disclosed in U.S. Pat. Nos. 3,656,905, 3,656,925 and 4,035,188.

Alternatively, a fast method of color development has been employed using a color developing agent having a hydrophilic group at the N-substituted position, such as a 4-amino-3-methyl-N-ethyl-N-β-methanesulfonamidoethylaniline salt and a 4-amino-3-methyl-N-ethyl-N-β-hydroxyethylaniline salt. Such a developer additionally contains benzyl alcohol, in order to accelerate the distribution of the color developing agent in the oil drop phases of a color photographic light-sensitive material.

However, such a method (using a hydrophobic group-containing agent, as described above) has the problem that when a color photographic material is color developed for a period of time of about 30 seconds or less, an insufficient contact of the developing agent with the lower emulsion layers of the color photographic material is effected, thereby producing developed color images having inferior color balance. Additionally, the presence of benzyl alcohol in the color developer may increase the coloring density in the uppermost emulsion layer but have little or no effect on the coloring density of the lowermost emulsion layer, thereby additionally causing poor or nonuniform color images on the developed photographic material and, hence, the addition of benzyl alcohol is not desired.

SUMMARY OF THE INVENTION

It is, therefore, an object of the present invention to provide a method for continuous processing of color photographic light-sensitive material which provides a developed photographic material having extended color fastness or stability, suitable for long storage, and additionally provides for fast development using relatively short periods of time in a developer.

Another object of the present invention is to provide a method for processing a color photographic light-sensitive material, characterized by producing reduced or no color developer waste while, at the same time, allowing for the use of relatively short development times.

In accomplishing the foregoing objects, there has been provided a method for developing an imagewise exposed silver halide color photographic material which comprises developing a color photographic material containing silver halide grains comprising (i) substantially no silver iodide and (ii) at least about 80 mol % silver chloride with a developer comprising (i) substantially no benzyl alcohol and (ii) a p-phenylenediamine derivative represented by the formula (I):

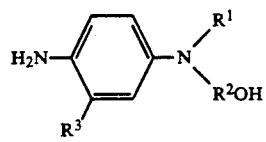

(I)

wherein $R^1$ and $R^2$ each represents an alkyl group having from 1 to 4 carbon atoms and $R^2$ represents a straight chain or branched alkylene group having 3 or 4 carbon atoms; for 30 seconds or less, preferably 20 seconds or less, and preferably at a temperature of at least 30° C.

Another embodiment of the present invention provides an amount of replenisher for a color developer that is not more than about 120 ml, and preferably from about 15 to 60 ml per square meter of the color photographic material.

According to another embodiment of the present invention, the above described developing process is carried out without using replenishers (however, water lost by evaporation can be replenished according to the present invention).

Developing time, in this context, refers to a period of time during which the color photographic material retains in contact with the bulk of a color developer.

DETAILED DESCRIPTION OF THE INVENTION

As the result of various investigations on a very fast development process of color photographic light-sensitive papers containing silver halide of a high silver chloride content using a p-phenylenediamine derivative as the color developing agent, it has now been found that the color developer containing the color developing agent being used in the present invention, which will be described below, enables good stable processing and fast processing in a low replenishing system and at the same time can provide color images having an excellent light fastness.

From the aforesaid matters, it has been concluded that the following two factors are important for attaining very fast processing of not longer than 30 seconds with less deviation of the photographic performance in continuous processing.

That is, the first factor is that a color developing agent is rapidly supplied to the lowermost emulsion layer of a color photographic material. That is, a color developing agent which is reluctant to be trapped in oil drop phases and which has a high diffusion rate is used. A developing agent having a hydrophilic group is preferably used. Also, it is preferred that benzyl alcohol accelerating the distribution of a color developing agent into oil drop phases is not used.

A second factor is that a color developing agent having a hydrophilic group and a high reducing power is used in order to enhance developability. Thus, the development activity of, for example, a 4-amino-3-methyl-N-ethyl-N-β-methanesulfonamidoethylaniline salt, which is used for processing color photographic papers at present, can be increased to be used in the method of the present invention by replacing the N-methanesulfonamido group of the salt with an N-hydroxyalkyl group. Such a replacement increases hydrophilic properties as a developer and, at the same time, increases its reducing power. But, the reduction of the light fastness of color images formed is unavoidable, as described above.

However, it has been discovered that by only replacing the hydroxyethyl group of the 4-amino-3-methyl-N-ethyl-N-β-hydroxyethylaniline salt with a hydroxypropyl group or a hydroxybutyl group, the fastness of the color images formed to light is, contrary to the expectation of the skilled artisan, greatly improved. It is an astonishing fact that a compound according to formula (I), as shown herein, wherein $R^2$ of the hydroxyalkyl group ($R^2OH$) is replaced with a straight chain or branched alkylene group having 3 or 4 carbon atoms, can provide color images having excellent long storage stability as described above.

Also, contrary to a compound according to formula (I), used in the method of the present invention, a compound having a straight chain or branched alkylene group having 5 or more carbon atoms as $R^2$ is inferior in the light fastness of colored images and greatly inferior in fast processing, to such a compound, used in the method of the present invention,.having a straight chain or branched alkylene group having 3 or 4 carbon atoms as $R^2$.

Thus, it has been found that a compound according to formula (I), wherein $R^2$ in the hydroxyalkyl group is a straight or branched group having 3 to 4 carbon atoms, and, in particular, 4 carbon atoms, is best in both light fastness of colored images formed and having the property of very fast processing times.

It has been found that particularly when the color development is carried out for a period of time as short as 30 seconds or less, the light fastness of all yellow, magenta and cyan color images is greatly improved and the stored images have an excellent color balance.

With respect to the magenta color images it has also been found that in the fast color development process of the present invention the storage stability of the color images are more greatly improved and the stain formation caused by storage can be more significantly inhibited with 2-equivalent couplers having an anion-releasing group introduced at a coupling position than with the conventional 5-pyrazolone based 4-equivalent couplers. It has also been found that preferably a pyrazoloazole based magenta coupler, particularly preferably a magenta coupler represented by formula (M-II) described hereinbelow can be used to obtain an image having a still further improved long term storage stability in a very fast development process.

As described above, it has been an unexpected fact that the combined use of the above mentioned color developing agent characterizing the present invention and a specific magenta coupler can provide a color image in a very fast development process which has a good long term storage stability and which is superior to images obtained by a conventional color developing agent.

Knowledge of the aforesaid color developing agent has not hitherto been known and it is considered to be a unique phenomenon for the color images obtained by very fast processing a color photographic material using a color developer comprising substantially no benzyl alcohol.

Practical aspects of the present invention are described in greater detail below.

A color developing agent used in the method of the present invention is represented by the following formula (I), as described above, as follows:

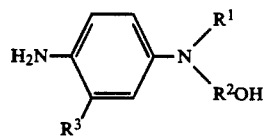

(I)

wherein $R^1$ and $R^2$ each represents an alkyl group having from 1 to 4 carbon atoms and $R^2$ represents a straight chain or branched alkylene group having 3 or 4 carbon atoms.

Specific examples of the alkyl group shown by $R^1$ and $R^2$ include methyl, ethyl, propyl, isopropyl, butyl, and sec-butyl. Also, specific examples of the alkylene group shown by $R^2$ include propylene, butylene, 1-methylethylene, 2-methylethylene, 1-methylpropylene, 2-methylpropylene, and 3-methylpropylene.

In formula (I), $R^1$ represents preferably ethyl or propyl; $R^3$ represents preferably methyl or ethyl; and $R^2$ represents preferably propylene or butylene as a main chain, and most preferably butylene.

A compound shown by formula (I) is very unstable in the case of storing the compound as a free amine and hence it is preferred that such a compound be generally stored as a salt of an inorganic acid or an organic acid and is used as a free amine, e.g., by adding such a compound to a color developer.

Examples of an inorganic acid and organic acid forming a salt of a compound of formula (I) include hydrochloric acid, sulfuric acid, phosphoric acid, p-toluenesulfonic acid, methanesulfonic acid, and naphthalene-1,5-disulfonic acid.

Specific examples of compounds shown by formula (I), which can be used as the color developing agent in the method of the present invention are illustrated below, but the present invention is not limited to these compounds.

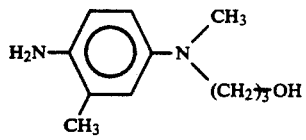

1)

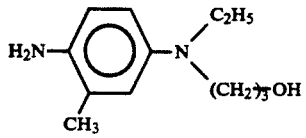

2)

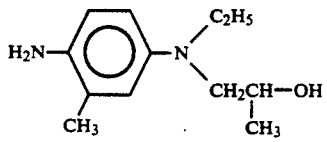

3)

-continued

4)

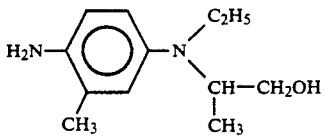

5)

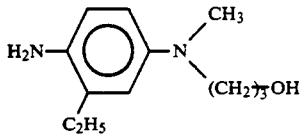

6)

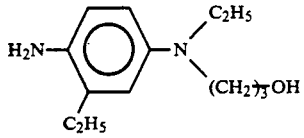

7)

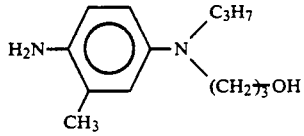

8)

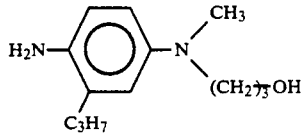

9)

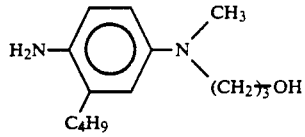

10)

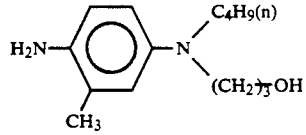

11)

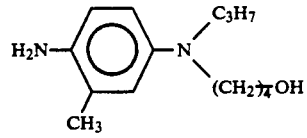

12)

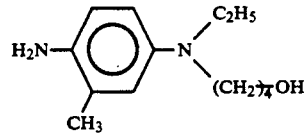

13)

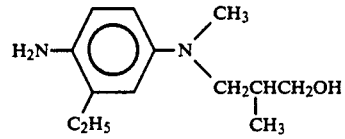

-continued

14)

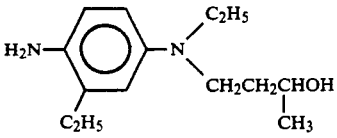

15)

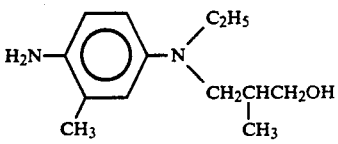

16)

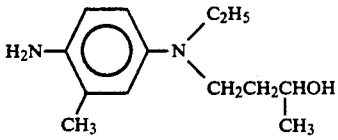

The amount (concentration) of the color developing agent being used in the method of the present invention is preferably in the range from about 0.2 to 60 g, and more preferably from about 1 to 30 g, per liter of color developer.

A processing temperature for a color developer is preferably in a range of about 30° to 50° C., in order to achieve development in a short period of time. Also, if the developing temperature is over about 50° C., Dmin (the minimum density) of color images formed is increased and hence the processing temperature is preferably lower than about 50° C.

Color developing agents, used in the method of the present invention, can be synthesized according to methods similar to those described in, e.g., the *Journal of American Chemical Society,* Vol. 73, 3100 (1951).

Color developing agents used in the method of the present invention can be used alone or together with another known p-phenylenediamine derivative. Specific examples of the compounds which can be used together with the color developing agent according to the method of the present invention are illustrated below, but the present invention is not limited to these compounds.

D-1: N,N-Diethyl-p-phenylenediamine

D-2: 2-Amino-5-diethylaminotriene

D-3: 2-Amino-5-(N-ethyl-N-laurylamino)toluene

D-4: 4-[N-Ethyl-N-(β-hydroxyethyl)amino]aniline

D-5: 2-Methyl-4-[N-ethyl-N-(β-hydroxyethyl-)amino]aniline

D-6: 4-Amino-3-methyl-N-ethyl-N-[β-(methanesulfonamido)ethyl]aniline

D-7: N-(2-Amino-5-diethylaminophenylethyl)methanesulfonamide

D-8: N,N-Dimethyl-p-phenylenediamine

D-9: 4-Amino-3-methyl-N-ethyl-N-methoxyethylaniline

D-10: 4-Amino-3-methyl-N-ethyl-N-β-ethoxyethylaniline

D-11: 4-Amino-3-methyl-N-ethyl-N-β-butoxyethylaniline

Of the aforesaid p-phenylenediamine derivatives, 4-amino-3-methyl-N-ethyl-N-[β-(methanesulfonamido)ethyl]aniline (Compound D-6) is particularly preferred.

Also, these p-phenylenediamine derivatives can be used in the form of salts, such as, e.g., sulfates, hydrochlorides, sulfites, p-toluenesulfonates, nitrates, and naphthalene-1,5-disulfonates.

An amount of aromatic primary amine developing agents can be from about 0.1 g to about 20 g per liter of color developer. Preferably, a p-phenylenediamine derivative used together can be used in an amount of from 1/10 mol to 10 mols per mol of a color developing agent according to formula (I), for use in the method of the present invention.

In accordance with a use of the present invention, color developer comprises substantially no benzyl alcohol. In the present invention, the term "comprising substantially no benzyl alcohol" means that a color developer can comprise less than about 2 ml/liter, more preferably less than about 0.5 ml/liter benzyl alcohol, and most preferably a color developer with no benzyl alcohol.

It is preferred that a color developer for use in the present invention also does not substantially comprise sulfite ion. Sulfite ion has a function as a preservative for a color developing agent, and at the same time, functions to dissolve silver halides and also to reduce dye-forming efficiency by reacting with an oxidized product of a color developing agent. Such a function is considered to be one of the causes of increased variation in the photographic developing characteristics, associated with continuous processing. The term "does not substantially comprise sulfite ion" means that a concentration of sulfite ion in a color developer, used in the present invention, is preferably less than about $3.0\times10^{-3}$ mol/liter, and most preferably a color developer of the present invention comprises no sulfite ion. However, a small amount of sulfite ion, used for preventing oxidation of a developer kit, which is comprised of a concentrated color developer, diluted at use, is outside the aforesaid definition in the present invention.

It is preferred that a color developer for use in the present invention does not substantially contain sulfite ion, as described above, and it is more preferred that the color developer does not substantially contain hydroxylamine. This is because hydroxylamine, used as a preservative for color developers and, at the same time, has a silver development activity by itself, thereby, it is considered that the deviation of the concentration of hydroxylamine in the developer gives adverse effects on the photographic characteristics of color images formed. The term "does not substantially comprise hydroxylamine" means that the concentration of hydroxylamine in the color developer is preferably less than about $5.0\times10^{-3}$ mol/liter, and the color developer comprises most preferably no hydroxylamine.

A color developer for use in the present invention contains more preferably an organic preservative in place of the aforesaid hydroxylamine and sulfite ion.

In this case, the term "organic preservative" means all organic compounds capable of reducing the rate of deterioration of an aromatic primary amine color developing agent, by adding a color developer for color photographic light-sensitive materials, such as organic compounds having a function of preventing a color developing agent from being oxidized by air, or other compounds.

Examples of particularly effective organic preservatives include hydroxylamine derivatives (excluding hydroxylamine, the same applies hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring type amines. Examples of these compounds are disclosed in JP-A-63-4235, JP-A-63-5341, JP-A-63-30845, JP-A-63-21647, JP-A-63-44655, JP-A-63-46454, JP-A-63-53551, JP-A-63-43140, JP-A-63-56654, JP-A-63-58346, JP-A-63-43138, JP-A-63-146041, JP-A-63-44657, JP-A-63-44646, and JP-A-52-143020, U.S. Pat. Nos. 3,615,503 and 2,494,903, JP-B-48-30496 (the term "JP-B" as used herein refers to an "examined Japanese patent publication"), and Japanese Patent Applications 185578/89, 198676/89, and 199646/89.

A color developer for use in the present invention can further contain other preservatives, such as, e.g., various kinds of metals, described in JP-A-57-44148 and JP-A-57-53749; salicylic acids, described in JP-A-59-180588; alkanolamines, described in JP-A-54-3532; polyethyleneimines, described in JP-A-56-94349; and aromatic polyhydroxy compounds described in U.S. Pat. 3,746,544. In the aforesaid preservatives, alkanolamines such as triethanolamine, etc., dialkylhydroxylamines such as diethylhydroxylamine, etc., hydrazine derivatives and aromatic polyhydroxy compounds are particularly preferred.

Of the aforesaid organic preservatives, hydroxylamine derivatives and hydrazine derivatives (hydrazines and hydrazides) are most preferred and details thereof are described, e.g., in JP-A-1-97953, JP-A-1-186939, JP-A-1-186940, and JP-A-1-187557.

In this case, it is more preferred to use the aforesaid hydroxylamine derivatives or hydrazine derivatives and the aforesaid amines together in order to improve the stability of the color developer and also to further improve the stability thereof during continuous processing.

Such amines include, e.g., cyclic amines, described in JP-A-63-239447; amines, described in JP-A-63-128340, and other amines, described in JP-A-1-186939 and JP-A-1-187557.

In the method of the present invention, it is preferred that a color developer comprise chloride ion in an amount in the range of from about $3.5\times10^{-3}$ to $3.0\times10^{-1}$ mol/liter, and more particularly from about $1\times10^{-2}$ to $2.0\times10^{-1}$ mol/liter.

If the content of chloride ion is more than about $3.0\times10^{-1}$ 1 mol/liter, the development is delayed and hence such a chloride content is undesirable for attaining an object of the present invention of giving high maximum density by fast processing. Also, if the chloride content is less than about $3.5\times10^{-3}$, the formation of fog is increased in the developed material.

In the method of the present invention, a color developer can be used that also comprises bromide ion in an amount of preferably from about $0.5\times10^{-5}$ to $1.0\times10^{-3}$ mol/liter, and more preferably from about $3.0\times10^{-5}$ to $5\times10^{-4}$ mol/liter.

If the bromide ion concentration is more than about $1\times10^{-3}$ mol/liter, the development is delayed and the maximum density and sensitivity are lowered, while if the bromide content is less than about $0.5\times10^{-5}$ mol/liter, the formation of fog cannot be sufficiently prevented.

In the method of the present invention, chloride ion and bromide ion can be directly added to a color developer or can be dissolved in a developer from color photographic light-sensitive materials during processing.

In the case of directly adding chloride ion to the color developer, as a chloride ion supplying material, sodium chloride, potassium chloride, ammonium chloride, lithium chloride, nickel chloride, magnesium chloride, manganese chloride, calcium chloride, and cadmium chloride can be used and sodium chloride and potassium chloride are preferred.

Also, chloride ion can be supplied into a color developer from an optical whitening agent contained in a color developer.

In the case of directly adding bromide ion, as a bromide ion supplying material, sodium bromide, potassium bromide, ammonium bromide, lithium bromide, calcium bromide, magnesium bromide, manganese bromide, cerium bromide, and thallium bromide can be used and potassium bromide and sodium bromide are preferred.

When chloride ion and bromide ion are dissolved into a developer from color photographic light-sensitive materials, the chloride ion and the bromide ion can be supplied from silver halide emulsion layers thereof or from other layers than the emulsion layers.

The pH of a color developer for use in the present invention is preferably from about 9 to 12, and more preferably from about 9 to 11.0.

A color developer may further contain other components.

For example, for maintaining the aforesaid pH, it is preferred to use various kinds of buffers. Such buffers include, e.g., carbonates, phosphates, borates, tetraborates, hydroxybenzoates, glycyl salts, N,N-dimethylglycine salts, leucine salts, norleucine salts, guanine salts, 3,4-dihydroxyphenylaranine salts, aranine salts, aminobutyrates, 2-amino-2-methyl-1,3-propanediol salts, valine salts, proline salts, trihydroxyaminomethane salts, lysine salts. Carbonates, phosphates, tetraborates, and hydroxybenzoates are particularly preferred since they are excellent in solubility and buffer capacity in a high pH range of at least 9.0 and have the advantages that they do not give adverse effects (e.g., fogging) to the developed photographic material when they are added to a color developer. These buffers are also inexpensive.

Suitable examples of these buffers that can be used in the method of the present invention include sodium carbonate, potassium carbonate, sodium hydrogencarbonate, potassium hydrogencarbonate, sodium tertiary phosphate, potassium tertiary phosphate, sodium dihydrogenphosphate, potassium dihydrogenphosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the method of the present invention is not limited to these compounds.

The amount of the buffer being added to a color developer is preferably at least about 0.1 mol/liter, and a range from about 0.1 to 0.4 mol/liter is particularly preferred.

Furthermore, a color developer may contain various kinds of chelating agents for preventing the precipitation of calcium and magnesium in a color developer or for improving the stability of a color developer used in the present invention.

Examples of suitable chelating agents are nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, these chelating agents can be used in combination.

The amount of the chelating agent can be sufficient for blocking metal ions in a color developer and can be present, for example, in concentrations from about 0.1 to 10 g per liter of color developer.

A color developer may further comprise a development accelerator.

As the development accelerator being used in the present invention, examples include thioether series compounds, e.g., as described in JP-B-37-16088, JP-B-37-5987, JP-B-38-7826, JP-B-44-12380 and JP-B-45-9019, and U.S. Pat. No. 3,813,247; p-phenylenediamine series compounds described in JP-A-52-49829 and JP-A-50-15554; quaternary ammonium salts described in JP-A-50-137726, JP-B-44-30074, JP-A-56-156826 and JP-A-52-43429; amine series compounds described in U.S. Pat. Nos. 2,494,903, 3,128,182, 4,230,796, 2,482,546, 2,596,926 and 3,582,346 and JP-B-41-11431; polyalkylene oxides described in JP-B-37-16088, JP-B-42-25201, JP-B-41-11431 and JP-B-42-23883, U.S. Pat. Nos. 3,128,183 and 3,532,501; 1-phenyl-3pyrazolidones, and imidazoles.

In the present invention, a color developer can also comprise an optional antifoggant.

As the antifoggant, suitable examples are alkali metal halides such as sodium chloride, potassium bromide, potassium iodide, and organic antifoggants. Typical examples of organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolebenzimidazole, 2-thiazolylmethylbenzimidazole, indazole, hydroxyazaindolizine, adenine, etc.

It is preferred that a color developer for use in the present invention can comprise an optical whitening agent, such as, preferably, 4,4'-diamino-2,2'disulfostilbene series compounds. The amount of the optical whitening agent that can be used in the present invention is from about 0 to 5 g/liter, and preferably from about 0.1 to 4 g/liter.

Also, a color developer can further comprise various kinds of surface active agents, such as alkylsulfonic acids, arylsulfonic acids, aliphatic carboxylic acids, and aromatic carboxylic acids.

In the case of reducing the amount of replenishers used, it is preferred to reduce the contact area of a processing solution with air, in order to prevent the occurrence of evaporation and oxidation of a processing solution.

The contact area of a photographic processing solution in a processing tank and air can be shown by the ratio defined below.

$$\text{Open Ratio} = (A)/(B)$$

(A): Contact area ($cm^{-2}$) of a processing solution and air
(B): Volume ($cm^3$) of the processing solution The aforesaid open ratio is preferably not higher than about 0.1 and preferably from about 0.001 to 0.05.

As a method for reducing the open ratio, e.g., placing a cover such as a float lid or other cover on the surface of a processing solution in a processing tank can be used, or, alternatively, using a movable lid, such as is described in JP-A-62-241342, or a slit processing process described in JP-A-63-216050.

It is preferred that a means for reducing the open ratio is applied to not only a color developer and a black-and-white developer but also to other various subsequent processing steps, such as bleaching, fixing (or bleach-fixing), washing, stabilizing.

A desilvering step which can be applied to the process of the present invention is further described below.

A desilvering step is generally composed of a bleaching step and fixing step; a fixing step and a bleach-fixing (blixing) step; a bleaching step and a blixing step; or a blixing step.

Then, a bleaching solution, a blixing solution, and a fixing solution, which can be applied to the present invention, are further described below.

As a bleaching agent which is used for a bleaching solution or a blixing solution, any bleaching agents can be used but, in particular, organic complex salts (e.g., complex salts of aminopolycarboxylic acids such as ethylenediaminetetraacetic acid, diethylenetriaminepentaacetic acid, or organic phosphonic acids, such as aminopolyphosphonic acid, phosphonocarboxylic acid) of iron(III); organic acids such as citric acid, tartaric acid, malic acid, etc.; persulfates; and hydrogen peroxide are preferred.

In these bleaching agents, organic complex salts of iron(III) are particularly preferred for fast processing and for the prevention of environmental pollution.

Examples of the aminopolycarboxylic acid, aminopolyphosphonic acid, organic phosphonic acid, or the salts thereof useful for forming the organic complex salts of iron(III) are ethylenediaminetetraacetic acid, diethylenetriaminepentaacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds can be in the form of sodium salts, potassium salts, lithium salts or ammonium salts.

In these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred because of their high bleaching strength.

These complex salts of ferric ion can be used in the form of a complex salt or a complex salt of ferric ion can be formed in a solution by using a ferric salt (such as ferric sulfate, ferric chloride, ferric nitrate, ferric ammonium sulfate, or ferric phosphate), and a chelating agent (such as aminopolycarboxylic acid, aminopolyphosphoric acid, or phosphonocarboxylic acid).

Of the ferric complex salts, a ferric salt of an aminopolycarboxylic acid is preferred and the amount thereof is from about 0.01 to 1.0 mol/liter, and preferably from about 0.05 to 0.50 mol/liter.

For a bleaching solution, a blixing solution and/or a prebath therefor various compounds can be used as a bleach accelerator.

Examples of bleach accelerator are compounds having a mercapto group or a disulfide bond described in U.S. Pat. No. 3,893,858, West German Patent 1,290,812, JP-A-53-95630, and Research Disclosure, No. 17129 (July, 1978); thiourea series compounds described in JP-B-45-8506, JP-A-52-20832 and JP-A-53-32735, and U.S. Pat. No. 3,706,561; halides such as iodides, bromides, etc. They are preferred due to their excellent bleaching strength.

Moreover, a bleaching solution or a blixing solution which can be applied in the present invention can further comprise a rehalogenating agent such as a bromide (e.g., potassium bromide, sodium bromide, and ammonium bromide), a chloride (e.g., potassium chloride, sodium chloride, and ammonium chloride), and an iodide (e.g., ammonium iodide).

Also, a bleaching solution or a blixing solution can comprise a corrosion inhibitor such as an inorganic acid or organic acid having a pH buffer capacity and the alkali metal or ammonium salts thereof (e.g., borax, sodium metaborate, acetic acid, sodium acetate, sodium carbonate, potassium carbonate, phosphorous acid, phosphoric acid, sodium phosphate, citric acid, sodium citrate, tartaric acid, and ammonium nitrate), and guanidine.

As the fixing agent which is used for a blixing solution or a fixing solution, thiosulfates such as sodium thiosulfate, ammonium thiosulfate; thiocyanates such as sodium thiocyanate, ammonium thiocyanate; thioether compounds such as ethylenebisthioglycolic acid, 3,6-dithia-1,8-octanediol, and water-soluble silver halide solvents such as thioureas can be used. They can be used alone or as a mixture.

Also, a specific blixing solution comprising a fixing agent and a large amount of a halide such as potassium iodide, e.g., as described in JP-A-55-155354 can be used in the present invention. In the present invention, the use of thiosulfates, in particular, ammonium thiosulfate, as a fixing agent is preferred.

The amount of a fixing agent is preferably from about 0.3 to 2 mols, and more preferably from about 0.5 to 1.0 mol per liter of a blixing solution or a fixing solution. The pH range of a blixing solution or a fixing solution is preferably from about 3 to 10, and particularly preferably from about 5 to 9.

Also, a blixing solution can further contain an optical whitening agent, a defoaming agent, a surface active agent, or an organic solvent, such as polyvinylpyrrolidone, methanol.

Furthermore, a blixing solution or a fixing solution preferably contains a preservative and as a preservative, sulfite ion-releasing compounds such as sulfites (e.g., sodium sulfite, potassium sulfite, and ammonium sulfite), bisulfites (e.g., ammonium bisulfite, sodium bisulfite, and potassium bisulfite), metabisulfites (e.g., potassium metabisulfite, sodium metabisulfite, and ammonium metabisulfite) can be used.

Such a preservative is contained in the processing solution in an amount of from about 0.02 to 0.05 mol/liter, and more preferably from about 0.04 to 0.40 mol/liter calculated as sulfite ion.

As the preservative, sulfites are generally used but ascorbic acid, a carbonyl-bisulfite addition product, or a carbonyl compound can be also added.

Furthermore, a blixing solution or a fixing solution can further comprise a buffer, an optical whitening agent, a chelating agent, a defoaming agent or an antifungal agent.

After a desilvering process, such as fixing or blixing, a washing step and/or a stabilizing step is generally applied.

The amount of washing water in a washing step can be selected from a wide range of conditions according to the characteristics of the previous step (e.g., materials such as couplers used) and ultimate use of a color photographic light-sensitive materials being processed, the temperature of a washing water, the number (stage number) of washing tanks, the replenishing system (countercurrent system or normal current system), and other various circumstances.

Of the aforesaid factors, the relation of a washing tanks and the amount of washing water in a multistage countercurrent system can be determined by a method, such as is described in *Journal of the Society of Motion Picture and Television Engineers*, Vol. 64, 248–253 (May, 1955). The stage number in a multistage countercurrent system used in the method of the present invention is preferably from about 2 to 6, and more preferably from about 2 to 4.

When a multistage countercurrent system is used in the present invention, the amount of washing water can be greatly reduced to, for example, from about 0.5 to 1 liter per square meter of the color photographic material (photographic paper) with a beneficial effect of the present invention. However, in the case of reducing the amount of washing water, there occurs a problem that by increasing the residence time in the tanks, bacteria increase and suspended matters thus formed attach to the color photographic materials being processed.

For solving the aforesaid problem, a method of reducing calcium and magnesium, e.g., as described in JP-A-62-288838, can be very effectively used. Also, chlorine series antibacterial agents, such as isothiazolone compounds and thiabendazoles described, e.g., in JP-A-57-8542 and chlorinated sodium isocyanurate described, e.g., in JP-A-61-120145; benzotriazole described, e.g., in JP-A-61-267761; copper ions; and antibacterial agents described, e.g., in Hiroshi Horiguchi, *Bohkin Bohbai no Kagaku (Antibacterial and Antifungal Chemistry)*, published by Sankyo Shuppan K.K. 1986, *Biseibutsu no Mekkin, Sakkin, Bohbai Gijutsu (Germicidal and Antifungal Techniques of Microorganisms)*, edited by Eisei Gijutsukai, published by Kogyo Gijutsukai, 1982, and *Bohkin Bohbai Zai Jiten (Antibacterial and Antifungal Agents Handbook)*, edited by Nippon Bohkin Bohbai Gakkai, can be used.

Furthermore, a surface active agent, for use as a wetting agent, and a chelating agent such as ethylenediaminetetraacetic acid (EDTA), for use as a water softener can be used in the washing water in the method of the present invention.

Subsequent to the aforesaid washing step, or without employing a washing step, color photographic materials can be processed by the use of a stabilizing solution. A stabilizing solution comprises a compound having an image stabilizing function and examples of such a compound are aldehyde compounds such as formalin, etc., buffers for controlling suitable pH of layers for the stabilization of dyes, and ammonium compounds. Also, a stabilizing solution can further comprise the aforesaid various kinds of antibacterial agents and antifungal agents for inhibiting the growth of bacteria in the solution and for imparting an antifungal property to the thus-developed color photographic material.

Furthermore, a stabilizing solution can also contain a surface active agent, an optical whitening agent, or a hardening agent.

When processing color photographic light-sensitive materials according to the process of the present invention, a color photographic material can be directly processed by a stabilizing step without employing a washing step, e.g., according to methods described in JP-A-57-8543, JP-A-58-14834, and JP-A-60-220345.

Furthermore, in a preferred embodiment, a stabilizing solution comprises a chelating agent such as 1-hydroxyethylidene-1,1-diphosphonic acid, and ethylenediaminetetramethylenephosphonic acid, or a magnesium or bismuth compound.

When a washing solution or a stabilizing solution is used after a desilvering process, a so-called rinse solution can be used.

The pH of washing water and stabilizing solution is preferably from about 4 to 10, and more preferably from about 5 to 8. The temperature for a washing step or a stabilizing step is variously selected according to the use and the characteristics of the color photographic light-sensitive material being processed, but is generally from about 15° C. to about 45° C., and preferably from about 20° C. to about 40° C. Processing time can be variably selected but a shorter time is preferred from the viewpoint of fast processing. Processing time is preferably from about 15 seconds to about 1 minute and 45 seconds, and preferably from about 30 seconds to about 90 seconds.

It is preferred that the amount of replenisher used for a processing solution be reduced in order to lower operating cost, the amount of waste solution, and the amount of processing of waste solution.

The amount of replenisher used can be from about 0.5 to 50 times, and preferably from about 3 to 40 times, the amount carried by a unit area of a color photographic material from a prebath. Also, the amount thereof can be less than 1 liter, preferably less than about 500 ml per square meter of color photographic material.

Also, a replenisher can be replenished continuously or intermittently.

Liquid used for a washing step and/or a stabilizing step can be reused for a previous step. As an example thereof, the amount of washing water is reduced by employing a multistage countercurrent system, an overflow liquid of washing water is supplied to a blixing bath which is a prebath therefor, and a concentrated liquid is replenished to the blixing bath, whereby the amount of the waste solution is reduced.

After a washing and/or stabilizing step, as described above, a color photographic material thus processed can be dried for about 10 seconds to about 10 minutes, at a temperature of from about 90° C. to about room temperature. In addition, a drying step may be omitted as is most suitable.

The aforesaid various kinds of processing solutions used in the present invention can be used at a temperature of from about 10° C. to about 50° C. A standard processing temperature is from about 33° C. to about 38° C. but it is possible to shorten the processing time by employing a higher processing temperature in order to accelerate the processing or to improve the image quality of color images formed. However, the stability of the processing solutions is improved by employing a lower processing temperature.

Also, for saving silver in a color photographic light-sensitive material, a processing method using cobalt intensification or hydrogen peroxide intensification, e.g., as described in West German Patent 2,226,770 and U.S. Pat. No. 3,674,499, can be employed.

The color photographic light-sensitive material (e.g., color photographic papers) being processed in the present invention generally has, on a support, at least one blue-sensitive silver halide emulsion layer, at least one green-sensitive silver halide emulsion layer, and at least one red-sensitive silver halide emulsion layer. In ordinary color photographic paper, the color-sensitive silver halide emulsion layers are formed on a support in the aforesaid order but the order of the emulsion layers may differ from the aforesaid order. Also, an infrared-sensitive silver halide emulsion layer can be used in place of at least one emulsion layer described above.

These light-sensitive emulsion layers each comprises each silver halide emulsion having a sensitivity to each wavelength region and each so-called color coupler forming each dye in a complementary color relation with the exposing light (color), that is, yellow dye to blue, magenta dye to green, or cyan dye to red, thereby a color reproduction by subtractive color process can be performed. In the present invention, however, different combinations than above, with regard to the coloring hue of each light-sensitive emulsion layer and each coupler, can be employed.

As a silver halide emulsion for use in the present invention, a silver halide emulsion composed of silver chlorobromide or silver chloride and containing substantially no silver iodide can be used. In the present invention, the term "comprising substantially no silver iodide" means that the content of silver iodide is less than about 1 mol %, and preferably less than about 0.2 mol %.

The halogen composition of the silver halide emulsion may differ among silver halide grains but, by using a silver halide emulsion having the same halogen composition among silver halide grains, the property of each silver halide grain can be easily made uniform.

Also, with regard to halogen composition distribution in the inside of silver halide grains of a silver halide emulsion used in the method of the present invention can comprise (1) silver halide grains of a so-called homogeneous type structure (the halogen compositions of any portions of the silver halide grains are the same), (2) a so-called laminate layer type structure (the halogen composition of the core in the inside of the silver halide grain differs from the halogen composition of the shell (one or plural layers) surrounding the core), or (3) a structure having a non-layer form portion having a different halogen composition than that of other portion in or at the surface of the silver halide grain (when such a portion is at the surface of the silver halide grains, the grain has a structure that the portion having the different halogen composition is junctioned to the edges, corners, or the surface of the grain). For obtaining high sensitivity, the latter two types of the silver halide grains are more advantageous than the former homogeneous type silver halide grains and also the latter types are also preferred for their pressure resistance. When silver halide grains have the latter type structures, the boundary portion between the portions each having a different halogen composition may form a distinct boundary or may form an indistinct boundary, formed by mixed crystals of different halogen compositions or may form a structure having a continuously changing halogen composition.

The halogen composition of these silver chlorobromide emulsions may have an alternative silver bromide/silver chloride ratio. This ratio can be selected in a wide range according to the intended use of the silver halide emulsion, but a silver chlorobromide emulsion having a silver chloride content of at least about 2% can be preferably used.

Also, for color photographic light-sensitive material suitable for fast processing, so-called high silver chloride emulsion having a high silver chloride content is preferably used. The silver chloride content of such a high silver chloride emulsion can be at least about 80 mol %, and can preferably be at least about 90 mol %, and more preferably at least about 95 mol %.

A high silver chloride emulsion has preferably the aforesaid structure wherein local silver bromide-containing portions exist in the interior and/or at the surface of silver halide grains, as a layer form or a non-layer form. In a halogen composition of the aforesaid local silver bromide-containing portions, the silver bromide content is preferably at least about 10 mol %, and more preferably over about 20 mol %. Also, these local silver bromide-containing portions can exist in the interior of the silver halide grains or at the edges, corners, or other surfaces of the grains. In one preferred embodiment, there are silver halide grains having such local silver bromide-containing portions epitaxially grown at the corner portions of the grains.

Alternatively, for inhibiting the reduction of the sensitivity of a color photographic light-sensitive material when a pressure is applied thereto, it is preferred to use silver halide grains of a heterogeneous type structure having a narrow distribution of halogen composition in the grains for a high silver chloride emulsion, e.g., having a silver chloride content of at least about 90 mol %.

Also, for the purpose of reducing the amount of the replenisher for the color developer, it is also effective to further increase the silver chloride content of a silver halide emulsion. In such a case, an almost pure silver chloride emulsion having the silver chloride content of from about 98 mol % to about 100 mol % is also preferably used.

Accordingly, by using a high silver chloride emulsion, as described above, the application of fast processing becomes possible and also the delay of development and the reproduction of gradation at continuous processing can be reduced.

Mean grain size (the number mean value of the diameters of circles equivalent to the projected areas of grains as the grain sizes) of the silver halide grains contained in the silver halide emulsion for use in the present invention is preferably from about 0.1 to 2 μm.

The grain size distribution of silver halide grains is preferably a so-called monodispersed distribution having a coefficient of variation (i.e., the standard deviation of the grain size distribution divided by the mean grain size) of about 20% or less, and preferably about 15% or less. In this case, it is preferred to use the aforesaid monodispersed emulsion in the same emulsion layer as a blend thereof or in double layers for obtaining a wide tolerance.

Silver halide grains contained in a silver halide photographic emulsion for use in the present invention may have a regular crystal form such as cubic, tetradecahedral, or octahedral, an irregular crystal form such as spherical, tabular, etc., or a composite form of these crystal forms. In the method of the present invention, it is preferred that a silver halide emulsion contain silver halide grains having the aforesaid regular crystal form in an amount of at least about 50%, preferably at least about 70%, and more particularly at least about 90%.

Furthermore, a silver halide emulsion containing silver halide grains, wherein tabular silver halide grains having an aspect ratio (circle-calculated length/thickness) of at least about 5, and preferably at least about 8, which accounts for at least 50% of the total projected area of the silver halide grains, can be preferably used.

Silver chlorobromide emulsion for use in the present invention can be prepared according to the methods described, e.g., in P. Glafkides, *Chimie et Physique Photographique,* published by Paul Montel, 1967; G. F. Duffin, *Photographic Emulsion Chemistry,* published by Focal Press, 1966; and V. L. Zelikman et al., *Making and Coating Photographic Emulsion,* published by Focal Press, 1964.

That is, a silver halide emulsion can be prepared by an acid method, a neutralization method, or an ammonia method, and, as a system of reacting a soluble silver salt and a soluble halide, a single jet method, a double jet method, or a combination thereof can be employed. A so-called reverse mixing method of forming silver halide grains in the existence of excess silver ions can also be employed. As one system of the double jet method, a so-called controlled double jet method of keeping a constant pAg in a liquid phase for forming silver halide grains can also be used. According to such a method, a silver halide emulsion comprising silver halide grains having a regular crystal size and substantially uniform grain sizes can be obtained.

Into a silver halide emulsion, for use in the present invention, can be introduced various kinds of multivalent metal ion impurities in a step of forming the silver halide grains or a step of physical ripening of the emulsions. Examples of metal ion impurities are salts of cadmium, zinc, lead, copper, thallium, etc.; and salts of complex salts of elements belonging to Group VIII of the Periodic system, such as iron, ruthenium, rhodium, palladium, osmium, iridium or platinum. In particular, the aforesaid elements belonging to the Group VIII can be preferably used. The amount of these compounds can be selected in a wide range according to the purpose of their use but is preferably from about $10^{-9}$ to $10^{-2}$ mol per mol of silver halide.

Silver halide emulsions for use in the present invention are usually subjected to chemical sensitization and to optical sensitization.

For chemical sensitization, a sulfur sensitization such as the addition of an unstable sulfur compound, a noble metal sensitization such as a gold sensitization, or a reduction sensitization can be applied singly or as a combination thereof. Preferred compounds which are used for chemical sensitization are described in JP-A-62-215272, pages 18 to 22.

Optical sensitization is applied for imparting an optical sensitivity to a desired wavelength region of each silver halide emulsion layer of the color photographic light-sensitive material being processed in the present invention. In the present invention, it is preferred to carry out optical sensitization by adding a spectral sensitizing dye (i.e., a dye that absorbs light of a wavelength region corresponding to the desired spectral sensitization).

Examples of spectral sensitizing dyes being used in the present invention are described in F. M. Harmer, *Heterocyclic Compounds, Cyanine Dyes and Related Compounds,* published by John Wiley & Sons (New York, London, 1964).

Practical examples and spectral sensitization method are described in JP-A-62-215272, pages 22 to 38.

Various kinds of compounds or the precursors thereof can be added to silver halide emulsions for use in the present invention for the purposes of preventing the occurrence of fog during the production and storage of a color photographic light-sensitive material or stabilizing the photographic performance thereof. Practical examples of the preferred compounds are described in JP-A-62-215272, pages 39 to 72.

A silver halide emulsions for use in the present invention may be a so-called surface latent image type emulsion which mainly forms latent images on the surfaces of silver halide grains or a so-called internal latent image type emulsion which mainly forms latent images in the interior of the grains.

When a process of the present invention is applied to a color photographic light-sensitive material, a yellow coupler, a magenta coupler, and a cyan coupler forming yellow, magenta, and cyan, respectively, can be coupled with the oxidation product of an aromatic amino color developing agent.

Cyan couplers, magenta couplers, and yellow couplers which can be preferably used in the present invention are shown by the following formulae (C-I) or (C-II), (M-I) or (M-II), and (Y), respectively.

With respect to stabilization (in particular, light fastness) of color images obtained using compounds of formula (I) in a fast development process, 5-pyrazolidone magenta couplers having an amino-releasing group at a coupling position or pyrazoloazole based magenta couplers are preferably used. Magenta couplers of formula (M-I), in which $Y_3$ is a releasable group, or of formula (M-II) are more preferred and magenta couplers of formula (M-II) are particularly preferred. These effects have not been expected from the phenomena observed in color photographic materials which contain conventional silver chlorobromide and are color developed for usual time of 3 minutes 30 seconds.

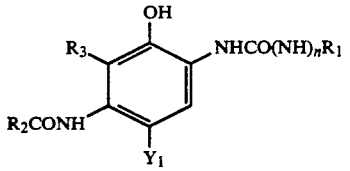

(C-I)

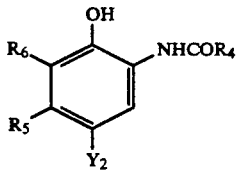

(C-II)

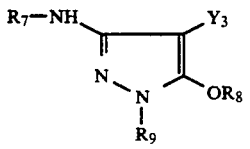

(M-I)

-continued

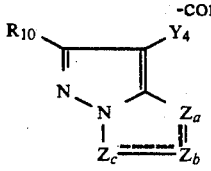

(M-II)

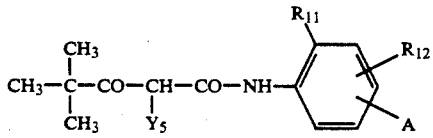

(Y)

In the aforementioned formulae (C-I) and (C-II), $R_1$, $R_2$, and $R_4$, each represents a substituted or unsubstituted aliphatic group, a substituted or unsubstituted aromatic group, or a substituted or unsubstituted heterocyclic group; $R_3$, $R_5$, and $R_6$ each represents a hydrogen atom, a halogen atom, an aliphatic group, an aromatic group, or an acylamino group, said $R_3$ may form a nonmetallic atomic group forming a nitrogen-containing 5-membered or 6-membered ring together with $R_2$; $Y_1$ and $Y_2$ each represents a hydrogen atom or a group capable of releasing at the coupling reaction with the oxidation product of an aromatic primary amino color developing agent; and n represents 0 or 1.

In formula (C-II), $R_5$ is preferably an aliphatic group and examples thereof are methyl, ethyl, propyl, butyl, pentadecyl, tert-butyl, cyclohexyl, cyclohexylmethyl, phenylthiomethyl, dodecyloxyphenylthiomethyl, butanamidomethyl, and methoxyethyl.

Preferred examples of cyan couplers used in the method of the present invention and shown by the aforementioned formulae (C-I) and (C-II) are as follows.

In formula (C-I), $R_1$ is preferably an aryl group or a heterocyclic group and is more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group or a cyano group.

In formula (C-I), when $R_3$ and $R_2$ do not form a ring, $R_2$ is preferably a substituted or unsubstituted alkyl group or aryl group, and particularly preferably an alkyl group substituted by a substituted aryloxy group; and $R_3$ is preferably a hydrogen atom.

In formula (C-II), $R_4$ is preferably a substituted or unsubstituted alkyl group or aryl group, and particularly preferred is an alkyl group substituted by a substituted aryloxy group.

In formula (C-II), $R_5$ is preferably an alkyl group having from 2 to 15 carbon atoms or a methyl group having a substituent of at least one carbon atom and examples of the substituent are an arylthio group, an alkylthio group, an acylamino group, an aryloxy group, and an alkyloxy group.

In formula (C-II), $R_5$ is more preferably an alkyl group having from 2 to 15 carbon atoms and is particularly preferably an alkyl group having from 2 to 4 carbon atoms.

In formula (C-II), $R_6$ is preferably a hydrogen atom or a halogen atom, and particularly preferably chlorine or bromine.

In formulae (C-I) and (C-II), $Y_1$ and $Y_2$ are preferably a hydrogen atom, a halogen atom, an alkoxy group, an aryloxy group, an acyloxy group, or a sulfonamido group.

In the aforesaid formula (M-I), $R_7$ and $R_9$ each represents an aryl group which may be substituted; $R_8$ represents a hydrogen atom, an aliphatic or aromatic acyl group, or an aliphatic or aromatic sulfonyl group; and $Y_3$ represents a hydrogen atom or a releasable group.

The aryl group (preferably a phenyl group) shown by $R_7$ and $R_9$ may be substituted as described above and examples of the substituent are those described above on the aryl group shown by $R_1$ in formula (C-I) and when the aryl group has two or more substituents, they may be the same or different. $R_8$ is preferably a hydrogen atom, an aliphatic acyl group or an aliphatic sulfonyl group, and particularly preferably a hydrogen atom. $Y_3$ which is preferred for stabilization of color images obtained by a fast development process using compounds of the above described formula (I) is a releasing group of a type of releasing by a sulfur, oxygen or nitrogen atom and is particularly preferably a sulfur atom-releasing type group as described in U.S. Pat. No. 4,351,897 and WO 88/04795.

In the aforesaid formula (M-II), $R_{10}$ represents a hydrogen atom or a substituent and $Y_4$ represents a hydrogen atom or a releasing group, and particularly preferably a halogen atom or an arylthio group. $Z_a$, $Z_b$ and $Z_c$ each represents a methine group, a substituted methine group, =N— or —NH—, one of the $Z_a$—$Z_b$ bond and the $Z_b$—$Z_c$ bond is a double bond and the other is a single bond. When the $Z_b$—$Z_c$ bond is a carbon-carbon double bond, it is a part of an aromatic ring. Also, the coupler shown by formula (M-II) can include formation of a dimer or a polymer at $R_{10}$ or $Y_4$ or when $Z_a$, $Z_b$ or $Z_c$ is a substituted methine group, it includes formation of a dimer or a polymer at the substituted methine.

Of the pyrazolotriazole series couplers shown by formula (M-II), imidazo[1,2-b]pyrazoles described in U.S. Pat. No. 4,500,630 are preferred when there is less yellow side adsorption and light fastness of colored dyes and the pyrazolo[1,5-b][1,2,4]triazoles described in U.S. Pat. No. 4,540,654 are particularly preferred.

Furthermore, pyrazolotriazole couplers having a branched alkyl group directly bonded to the 2-, 3- or 6-position of the pyrazolotriazole ring, e.g., as described in JP-A-61-65245, pyrazoloazole couplers having a sulfonamido group in the molecule as described, e.g., in JP-A-61-65246, pyrazoloazole couplers having an alkoxyphenylsulfonamido ballast group as described, e.g., in JP-A-61-147254, and pyrazolotriazole couplers having an alkoxy group or an aryloxy group at the 6-position as described, e.g., in European Patent Publications 226,849 and 294,785 are preferably used.

In the aforesaid formula (Y), $R_{11}$ represents a halogen atom, an alkoxy group, a trifluoromethyl group, or an aryl group; $R_{12}$ represents a hydrogen atom, a halogen atom, or an alkoxy group; A represents —$NHCOR_{13}$, —$NHSO_2$—$R_{13}$, —$SO_2NHR_{13}$, —$COOR_{13}$, or $$-SO_2\underset{\underset{R_{14}}{|}}{N}-R_{13},$$

(wherein $R_{13}$ and $R_{14}$ each represents an alkyl group, an aryl group or an acyl group); and $Y_5$ represents a releasable group.

The groups shown by $R_{12}$, $R_{13}$, and $R_{14}$ may have a substituent and examples of the substituent are those shown above on $R_1$ in formula (C-I). The releasable group shown by $Y_5$ is a group released by an oxygen atom or a nitrogen atom, and further a nitrogen atom-releasable type is particularly preferred.
Then, specific examples of the couplers shown by formulae (C-I), (C-II), (M-I), (M-II), and (Y) described above are illustrated below.
(C-1)
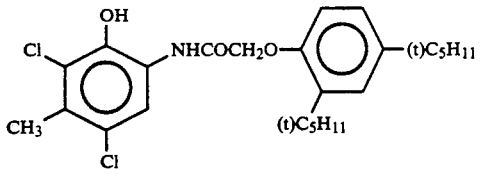
(C-2)
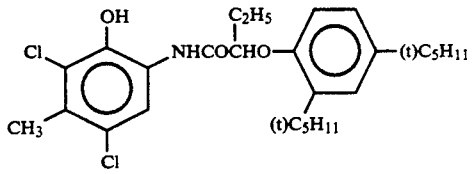
(C-3)
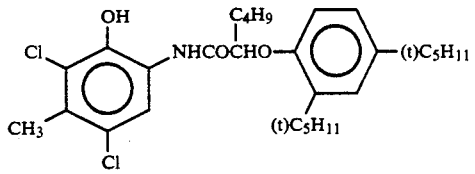
(C-4)
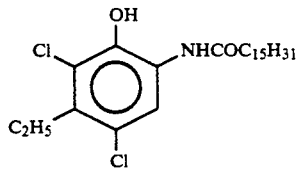
(C-5)
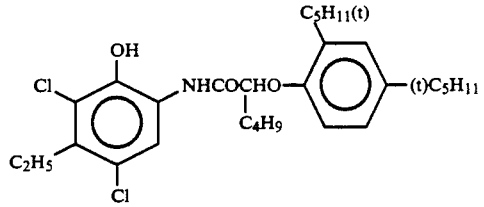
(C-6)
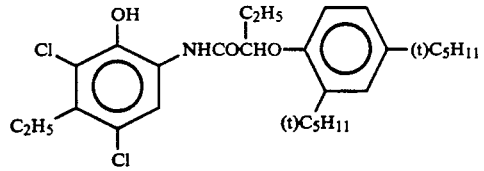
(C-7)
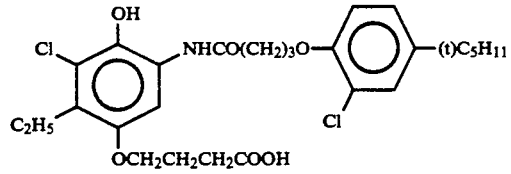
(C-8)
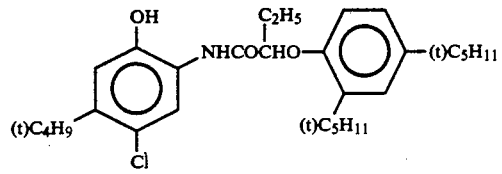

-continued
(C-9)
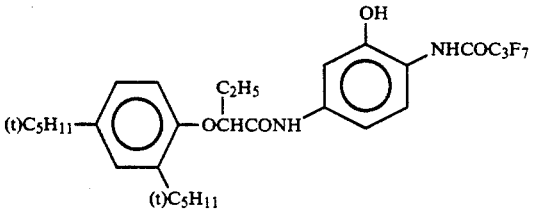
(C-10)
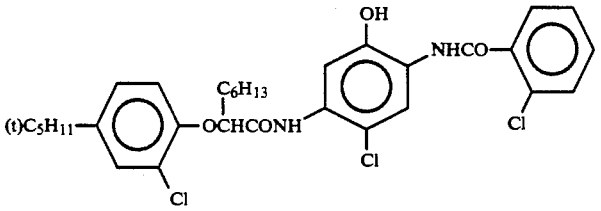
(C-11)
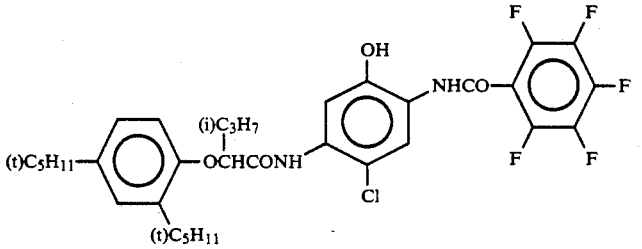
(C-12)
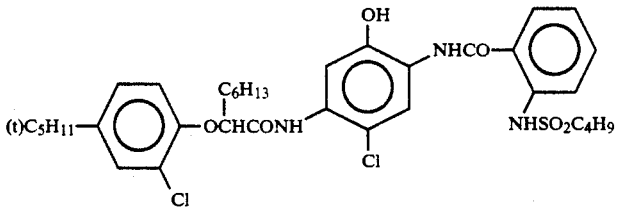
(C-13)
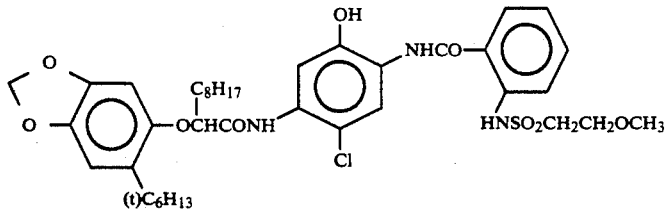
(C-14)
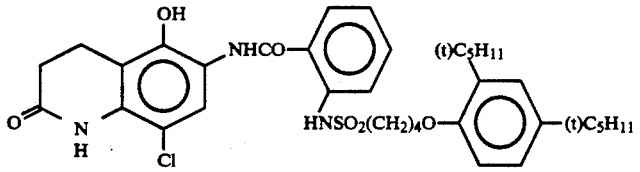
(C-15)
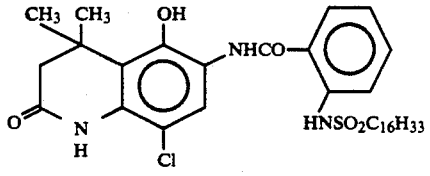

-continued
(C-16)
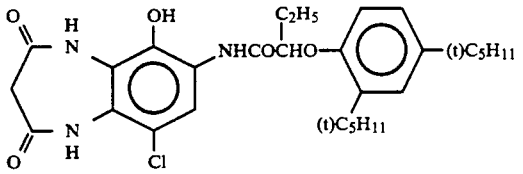
(C-17)
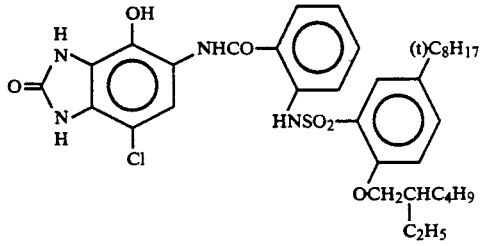
(C-18)
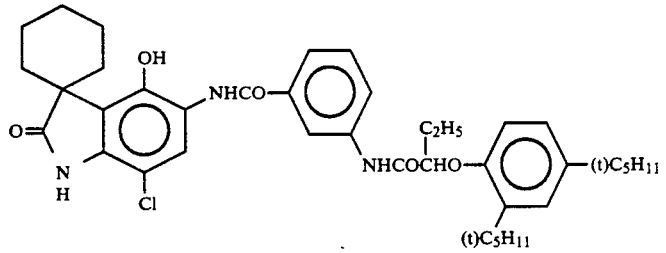
(C-19)
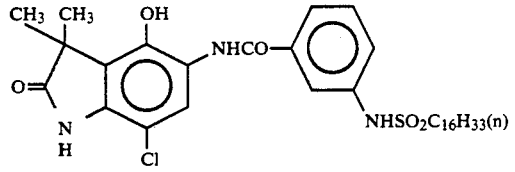
(C-20)
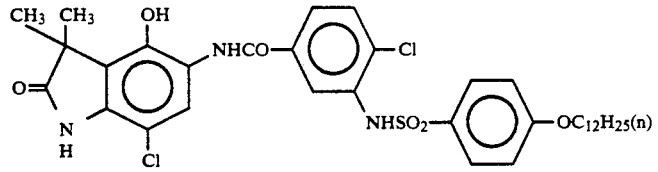
(C-21)
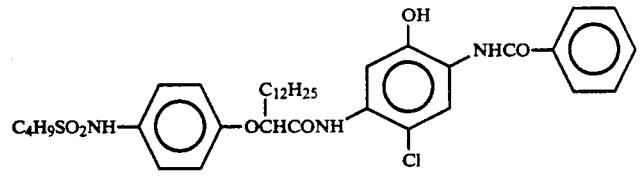
(C-22)
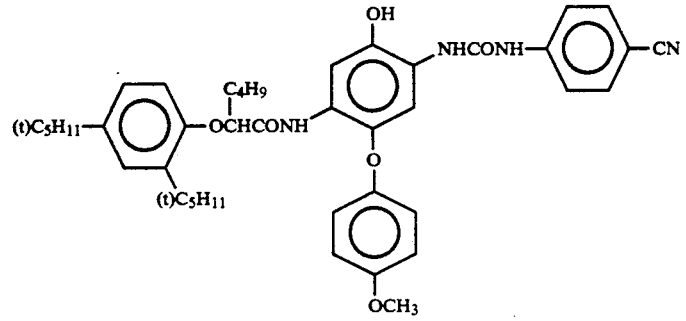

-continued
(M-1)
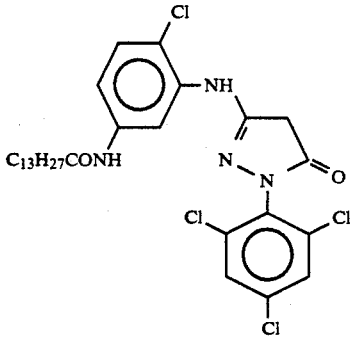
(M-2)
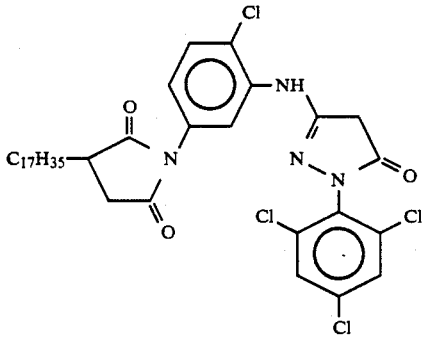
(M-3)
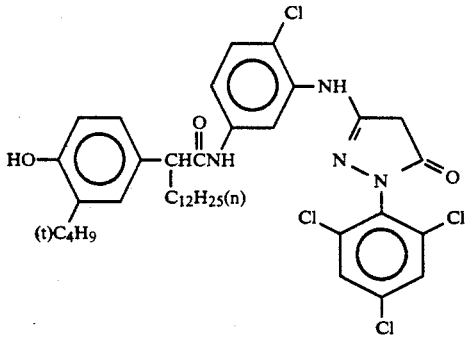
(M-4)
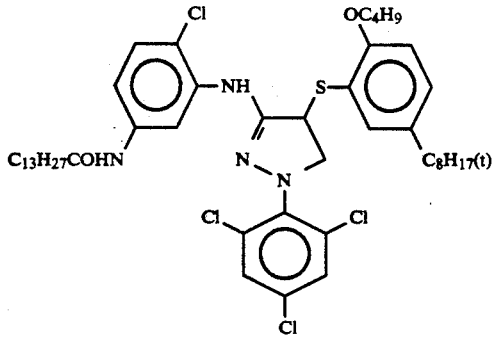

-continued
(M-5)
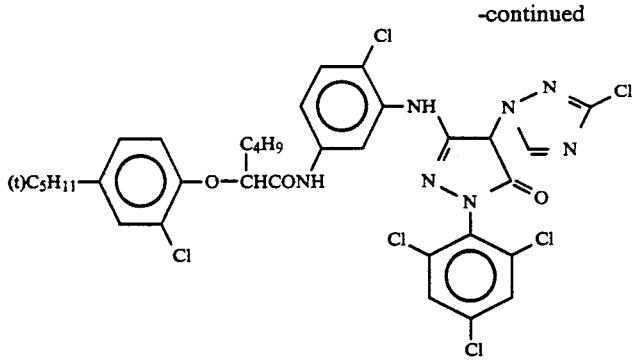
(M-6)
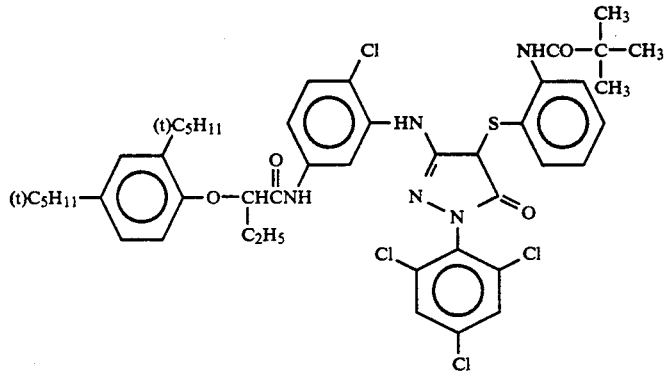
(M-7)
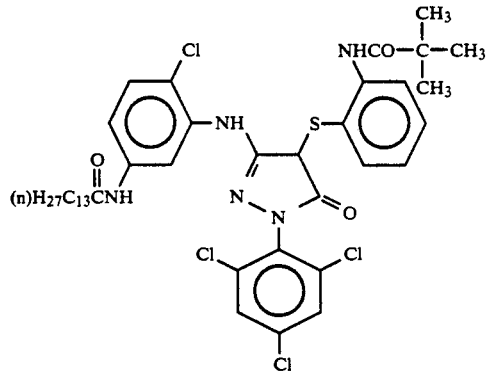
(M-8)
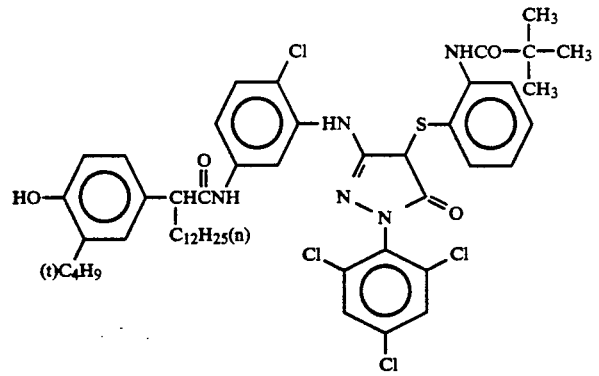

| Compound | $R_{10}$ | $R_{15}$ | $Y_4$ |
|---|---|---|---|
| | | 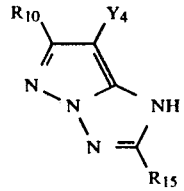 | |
| M-9 | $CH_3$— | 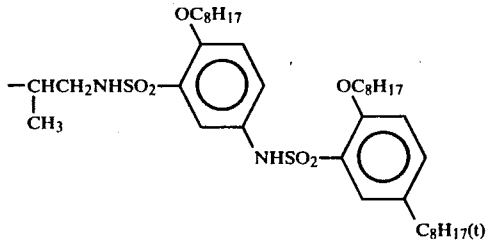 | Cl |
| M-10 | " | 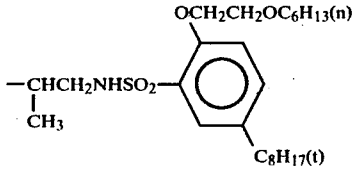 | " |
| M-11 | $(CH_3)_3C$— | 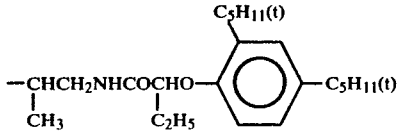 | 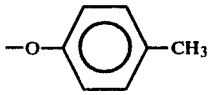 |
| M-12 | 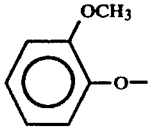 | 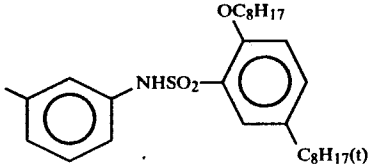 | 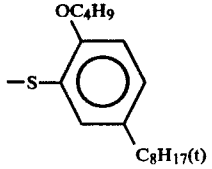 |

-continued
| Compound | $R_{10}$ | $R_{15}$ | $Y_4$ |
|---|---|---|---|
| M-13 | $CH_3$— | 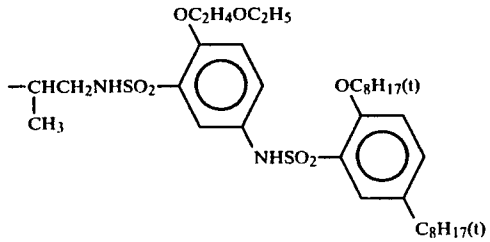 | Cl |
| M-14 | " | 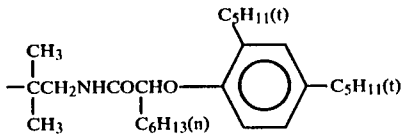 | " |
| M-15 | " | 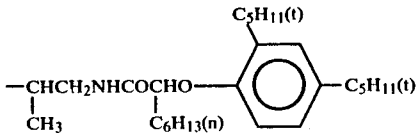 | " |
| M-16 | $CH_3$— | 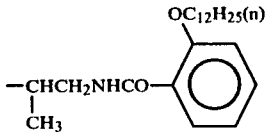 | Cl |
| M-17 | " | 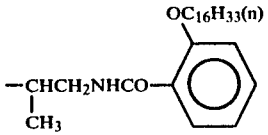 | " |

-continued
| Compound | $R_{10}$ | $R_{15}$ | $Y_4$ |
|---|---|---|---|
| M-18 | 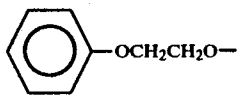 | 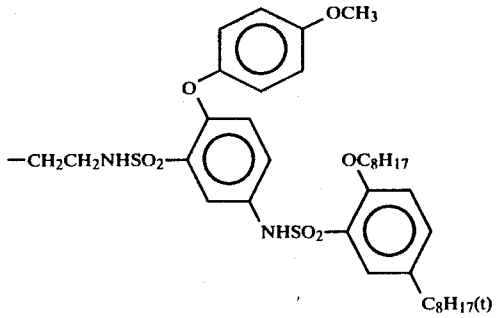 | 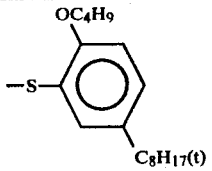 |
| M-19 | $CH_3CH_2O$— | " | " |
| M-20 | 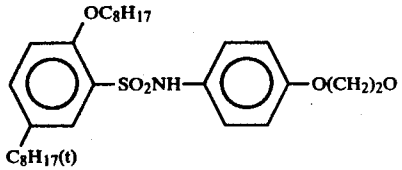 | 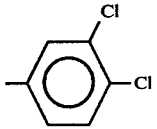 | 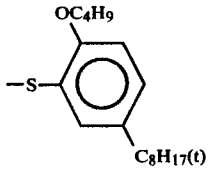 |
| M-21 | 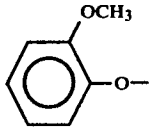 | 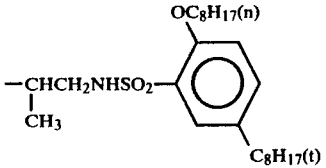 | Cl |
| | 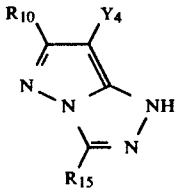 | | |
| M-22 | $CH_3$— | 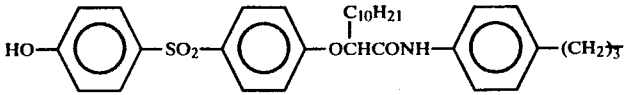 | Cl |

-continued
| Compound | $R_{10}$ | $R_{15}$ | $Y_4$ |
|---|---|---|---|
| M-23 | " | 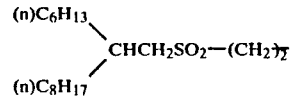 | " |
| M-24 | 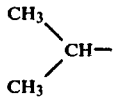 | 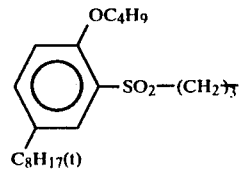 | " |
| M-25 | 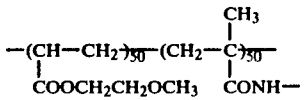 | 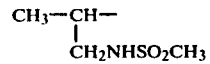 | " |
| M-26 | 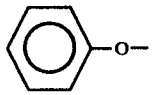 | 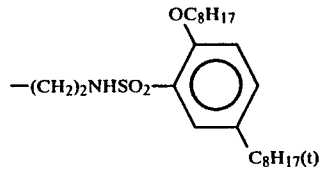 | Cl |
| M-27 | $CH_3$— | 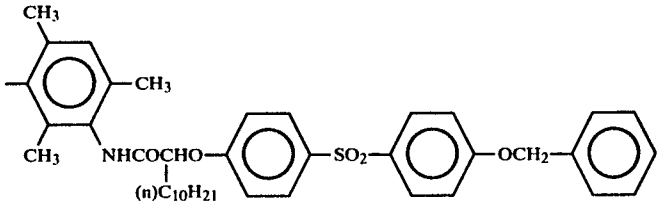 | " |
| M-28 | $(CH_3)_3C$— | 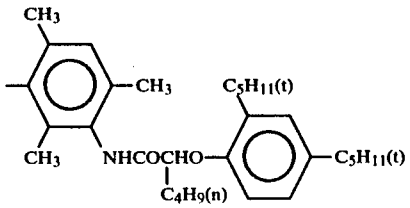 | " |

-continued
| Compound | $R_{10}$ | $R_{15}$ | $Y_4$ |
|---|---|---|---|
| M-29 | 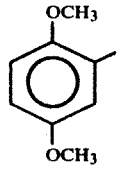 | 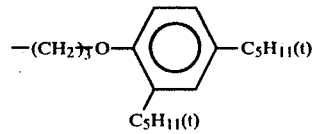 | Cl |
| M-30 | $CH_3$— | $-CH(C_2H_5)-N(n)C_{18}H_{37}COCH_2CH_2COOH$ | " |

(Y-1)
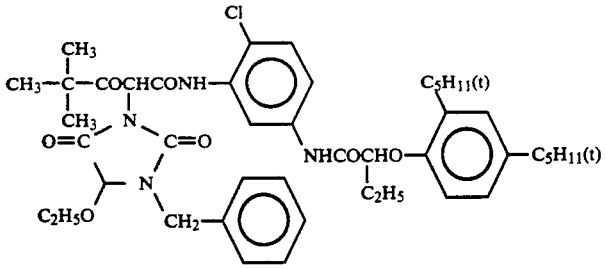
(Y-2)
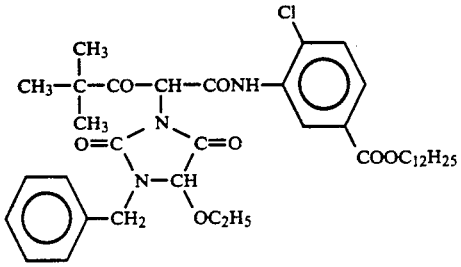
(Y-3)
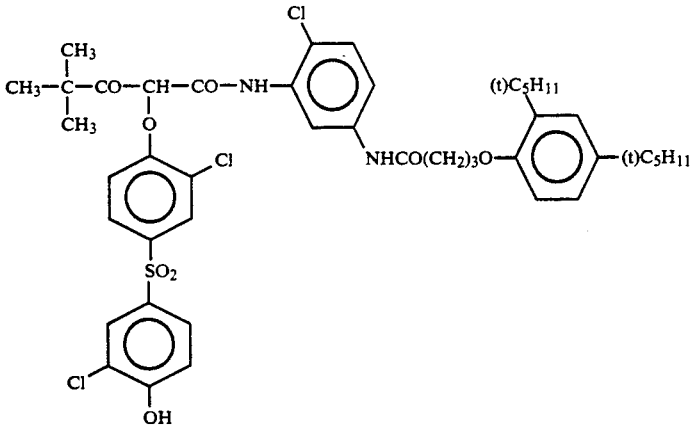
(Y-4)
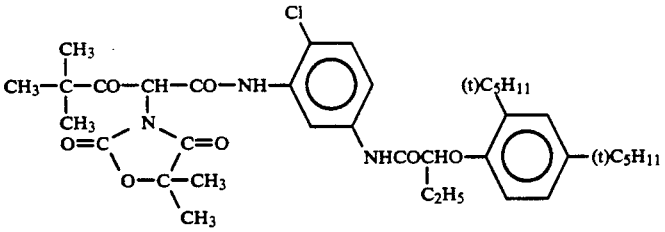
(Y-5)
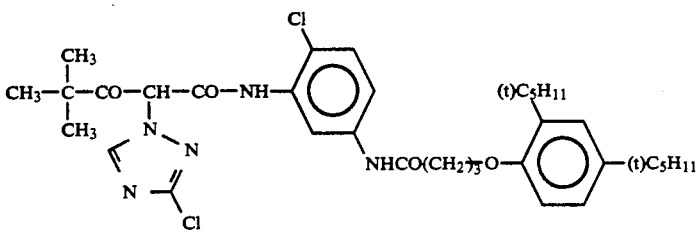

-continued (Y-6)

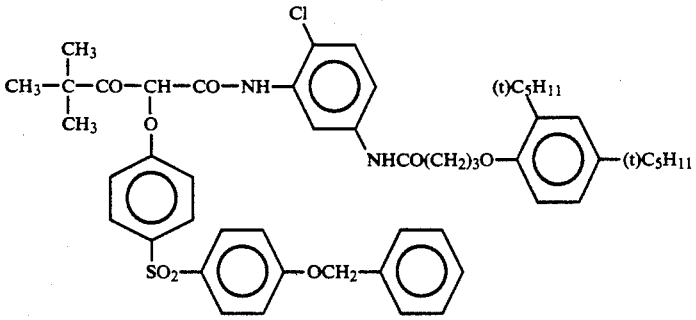

(Y-7)

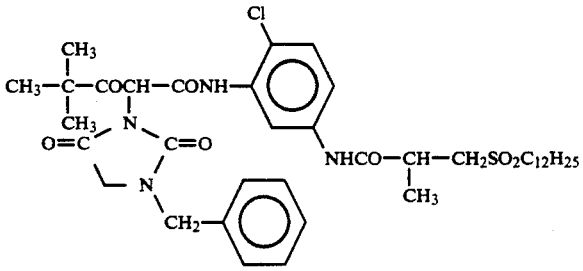

(Y-8)

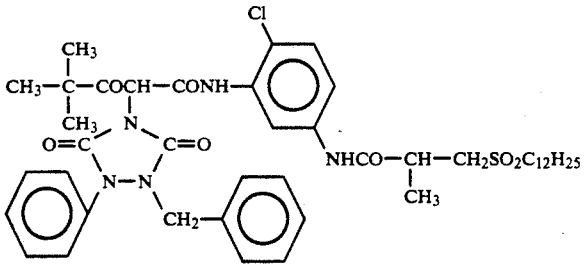

(Y-9)

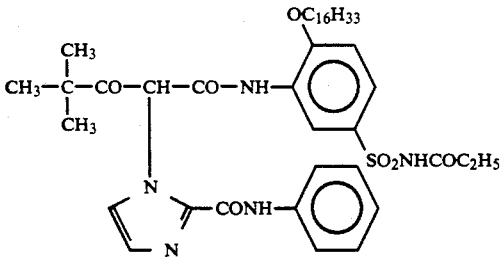

According to the method of the present invention, each of the couplers shown by the aforesaid formulae (C-I) to (Y) is incorporated in a silver halide emulsion layer constituting the color photographic light-sensitive material from 0.1 to 1.0 mol, and preferably from 0.1 to 0.5 mol, per mol of the silver halide in the emulsion.

In the present invention, various techniques can be employed for adding the aforesaid couplers to a silver halide emulsion layer.

Usually, an oil drop-in-water dispersion method, which is also known as an oil protect method, can be employed. That is, after dissolving the coupler in an organic solvent, the solution is dispersed by emulsification in an aqueous gelatin solution containing a surface active agent. Alternatively, water or an aqueous gelatin solution is added to a coupler solution in an organic solvent containing a surface active agent to form an oil-in-water dispersion with phase inversion.

Also, when the coupler is soluble in an alkaline aqueous solution, the coupler can be dispersed by a so-called Fischer's dispersion method.

After removing a low boiling organic solvent from a coupler dispersion by distillation, noodle washing, or ultrafiltration, the dispersion may be mixed with a photographic emulsion.

As a dispersion medium for such a coupler, a high boiling organic solvent having a dielectric constant of from about 2 to 20 (25° C.) and a refractive index of from about 1.5 to 1.7 (25° C.) and/or a water-insoluble high molecular compound is preferably used.

As a high boiling organic solvents, the high boiling organic solvents shown by, but not limited to, the following formulae (A) to (E) are preferably used.

(A)

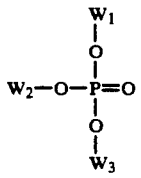

-continued $W_1—COO—W_2$ (B)

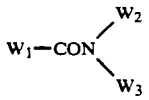
(C)

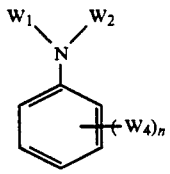
(D)

$W_1—O—W_2$ (E)

wherein $W_1$, $W_2$ and $W_3$ each represents an alkyl group, a cycloalkyl group, an alkenyl group, an aryl group, or a heterocyclic group, each group may be substituted or unsubstituted; $W_4$ represents $W_1$, $OW_1$, or $S—W_1$; and n represents an integer of from 1 to 5, when n is 2 or more, $W_4$s may be the same or different, and also $W_1$ and $W_2$ in formula (E) may form a condensed ring.

In the present invention, other high boiling organic solvents than those shown by the aforesaid formulae (A) to (E) can be also used if they are water-immiscible compounds having a melting point of not higher than about 100° C. and a boiling point of at least about 140° C., and are good solvents for the couplers.

A melting point of a high boiling organic solvent which can be used in the method of the present invention is preferably not higher than about 80° C. and the boiling point thereof is preferably at least about 160° C., and more preferably at least about 170° C.

Typical examples of such high boiling organic solvents are described, e.g., in JP-A-62-215272, pages 137, right lower column to 144, right upper column.

Also, the aforesaid coupler can be emulsion-dispersed in an aqueous solution of a hydrophilic colloid by impregnating a loadable latex polymer with a coupler in the presence or absence of the aforesaid high boiling organic solvent (e.g., U.S. Pat. No. 4,203,716) or by dissolving the coupler in a water-insoluble and organic solvent-soluble polymer or homopolymer.

Such a homopolymer or polymer, e.g., acrylamide series polymers described in WO 88/00723, are preferably used for stabilizing color images in the method of the present invention.

A color photographic light-sensitive material processed by the process of the present invention can comprise, e.g., hydroquinone derivatives, aminophenol derivatives, gallic acid derivatives, and ascorbic acid derivatives, as color fog inhibitors.

For color photographic light-sensitive materials being processed by the method of the present invention, various fading inhibitors can also be used. For example, as organic fading inhibitors for cyan, magenta, and/or yellow color images, there are hindered phenols such as hydroquinones, 6-hydroxychromans, 5-hydroxycoumarans, spirochromans, p-alkoxyphenols, and bisphenols; gallic acid derivatives; methylenedioxybenzenes; aminophenols; hindered amines; and the ether or ester derivatives formed by silylating or alkylating the phenol hydroxy group of each of the aforesaid compounds. Also, metal complexes such as (bissalicylaldoximato)-nickel complexes and (bis—N,N-dialkyldithiocarbamato)nickel complexes can be used.

Specific examples of the organic fading inhibitor include, e.g., hydroquinones described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028, and British Patent 1,363,921; 6-hydroxychromans, 5-hydroxycoumarans, and spirochromans described in U.S. Pat. Nos. 3,432,300, 3,573,050, 3,574,627, 3,698,909 and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, methylenedioxybenzenes, and aminophenols described in U.S. Pat. Nos. 3,457,079 and 4,332,886 and JP-B-56-21144; hindered amines described in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and British Patent 2,027,731(A).

An organic fading inhibitor, as described above, can be coemulsified with a corresponding color coupler in an amount of from about 5 to 100% by weight, and then added to a light-sensitive silver halide emulsion layer, and used in the method of the present invention.

Also, for preventing the deterioration of cyan dye images by heat and, in particular, light, an ultraviolet absorber can be introduced into a cyan coloring emulsion layer and layers adjacent to both sides of the cyan coloring layer, as used in the method of the present invention.

Examples of the ultraviolet absorbers are benzotriazole compounds substituted by an aryl group described, e.g., in U.S. Pat. No. 3,533,794; 4-thiazolidone compounds described, e.g., in U.S. Pat. Nos. 3,314,794 and 3,352,681; benzophenone compounds described, e.g., in JP-A-46-2784; cinnamic acid ester compounds described, e.g., in U.S. Pat. Nos. 3,705,805 and 3,707,395; butadiene compounds described, e.g., in U.S. Pat. No. 4,045,229; and benzoxazole compounds described, e.g., in U.S. Pat. Nos. 3,406,070, 3,677,672 and 4,271,307.

Furthermore, ultraviolet absorptive couplers (e.g., α-naphthol series cyan dye forming couplers) and ultraviolet absorptive polymers can be mordanted to specific emulsion layers.

In the aforesaid compounds, benzotriazole compounds substituted by an aryl group described above are preferred.

Also, it is preferred to use the aforesaid coupler together with each of the following compounds. As the coupler, pyrazoloazole couplers are particularly preferred.

That is, it is preferred that a coupler is used together with a compound (F) (as described herein) forming a chemically inert and substantially colorless compound by chemically bonding with an aromatic amino color developing agent remaining after color development and/or a compound (G) (as described herein) forming a chemically inert and substantially colorless compound by chemically bonding with an oxidation product of an aromatic amino color developing agent remaining after color development since the formation of stains and the occurrence of other undesirable side reactions by the reaction of the coupler and the color developing agent or the oxidation product thereof, remaining in the photographic emulsion layers of color photographic materials during the storage thereof after processing, can be prevented.

A compound (F) is capable of reacting with p-anisidine at a secondary reaction rate constant $k_2$ (in trioctyl phosphate at about 80° C.) in the range of from about 1.0 liter/mol·sec to $1\times10^{-5}$ liter/mol·sec.

In addition, the secondary reaction rate constant $k_2$ described above can be measured by a method described, e.g., in JP-A-63-158545.

If $k_2$ is larger than the aforesaid range, the compound itself becomes unstable and sometimes decomposes by reacting with gelatin or water. On the other hand, if $k_2$ is less than the aforesaid range, the reaction with the remaining aromatic amino developing agent is delayed, which results in the inhibition of side reactions by the remaining aromatic amino color developing agent.

A compound (F) is more preferably a compound represented by the following formula (FI) or (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 0 or 1; A represents a group forming a chemical bond by reacting with an aromatic amino developing agent; X represents a group released by reacting with an aromatic amino color developing agent; B represents a hydrogen atom, an aliphatic group, an aromatic group, a heterocyclic group, an acyl group, or a sulfonyl group; and Y represents a group of accelerating the addition of an aromatic amino color developing agent to the compound of formula (FII); said $R_1$ and X, or said Y and $R_2$ or B may combine with each other to form a ring structure.

Typical systems for chemically bonding the aforesaid compound and the remaining aromatic amino color developing agent are a displacement reaction and an addition reaction.

Specific examples of the preferred compounds shown by the aforesaid formula (FI) or (FII) are described, e.g., in JP-A-63-158545 and JP-A-62-283338, and European Patent Publication (unexamined) Nos. 298321 and 277589.

On the other hand, preferred examples of a compound (G), forming a chemically inert and substantially colorless compound by chemically bonding with the oxidation product of an aromatic amino color developing agent remaining after color development, can be shown by the following formula (GI):

$$R-Z \quad \text{(GI)}$$

wherein R represents an aliphatic group, an aromatic group or a heterocyclic group; and Z represents a nucleophilic group or a group releasing a nucleophilic group by being decomposed in a color photographic material In the compound shown by formula (GI), it is preferred that Z is a group wherein the Pearson's nucleophilic $^nCH_3I$ value (R. G. Pearson et al., *Journal of American Chemical Society*, 90, 319 (1968)) is at least 5 or a group derived from that group.

Specific examples of a preferred compound shown by formula (GI) are described, e.g., in European Patent Publication (unexamined) Nos. 255722, 298321, and 277589, JP-A-62-143048 and JP-A-62-229145, JP-A-1-57259, and JP-A-1-230039.

Details of a combination of the aforesaid compound (G) and compound (F) are described, e.g., in European Patent Publication (unexamined) 277589.

A color photographic light-sensitive material being processed by the method of the present invention may contain a water-soluble dye or a dye which becomes water-soluble by photographic processing in a hydrophilic colloid layer, as a filter dye, or for preventing irradiation and halation, and for other various purposes. Such dyes include oxonol dyes, hemioxonol dyes, styryl dyes, merocyanine dyes, cyanine dyes, and azo dyes. In these dyes, oxonol dyes, hemioxonol dyes, and merocyanine dyes are preferred.

As a binder or a protective colloid which can be used for photographic layers of the color photographic light-sensitive materials being processed in the present invention, gelatin is advantageously used but other hydrophilic colloid can be also used solely or together with gelatin.

In the present invention, gelatin being used may be lime-processed gelatin or acid-processed gelatin. Details of the production of such a gelatin are described, e.g., in Arther Vaise, *The Macromolecular Chemistry of Gelatin*, published by Academic Press, 1964.

As a support for the color photographic light-sensitive material being processed by the process of the present invention, a transparent film such as a cellulose nitrate film or a polyethylene terephthalate film (which is usually used for photographic films) or a reflection type support can be used. In the present invention, the use of a reflective support is more preferably used.

The term "reflective support" means a support clearly showing the color images formed in the silver halide emulsion layer(s) formed thereon by increasing the reflectivity of the support. Such a reflective support includes a support coated with a hydrophobic resin containing, dispersed therein, a light reflecting material, such as titanium oxide, zinc oxide, calcium carbonate, and calcium sulfate, and a support composed of a hydrophobic resin containing the aforesaid light reflecting material.

Examples of a reflective support are baryta-coated papers, polyethylene-coated papers, polypropylene synthetic papers, and transparent supports such as glass sheets, films of polyesters (such as polyethylene terephthalate, cellulose triacetate and cellulose diacetate), polyamide films, polycarbonate films, polystyrene films, vinyl chloride series films which can be coated or mixed with the aforesaid reflective material.

Other reflective supports, such as a support having a mirror plane reflective or second kind of reflective metal surface can be used. Such a metal surface has preferably a spectral reflectivity in a visible wavelength range of at least 0.5 and also is preferred to render the metal surface diffuse-reflective by roughening the surface or using a metal powder.

As a metal, aluminum, tin, silver, magnesium, or an alloy thereof can be used and the surface of the support may be the surface of a metal plate formed by rolling or a metal thin layer formed by vapor deposition or plating. Also, the surface may be formed by a metal foil. Of these supports, a support having a vapor-deposited metal layer is preferably used.

It is also preferred that a layer of a water resisting resin be formed, in particular, a thermoplastic resin.

It is also preferred that an antistatic layer is formed on the opposite side of the support to the metal surface side. Details of these supports are described in JP-A-61-210346, JP-A-63-24247, JP-A-63-24251 and JP-A-63-24255. These supports are selected according to which purpose they are used for.

As a light reflective material, it is preferred to sufficiently knead a white pigment in the presence of a surface active agent, and also pigment particles, the surfaces of which have been treated with di- to tetrahydric alcohol are preferably used.

The occupied area ratio (%) per defined unit area of white pigment fine particles can be most typically determined by dividing an observed area into adjacent area of about 6 $\mu m \times 6$ $\mu m$ each and measuring the occupied area ratio (%) ($R_i$) of the fine particles projected to each unit area.

The coefficient of variation of the occupied area ratio (%) can be determined by the ratio (s/R) of the standard deviation (s) of $R_i$ to the mean value (R) of $R_i$. The number (n) of the unit areas being measured is preferably 6 or more. Thus, the coefficient of variation s/R can be obtained by the following equation:

$$\frac{\sqrt{\dfrac{\sum_{i=1}^{n}(R_i-\bar{R})^2}{n-1}}}{\dfrac{\sum_{i=1}^{n}R_i}{n}}$$

In the present invention, the coefficient of variation of the occupied area ratio (%) of the fine particles of a pigment is preferably less than about 0.15, and particularly preferably less than about 0.12. When the coefficient of variation is less than about 0.08, the dispersibility of the particles can be said to be substantially "uniform".

As the image-forming system including the process of the present invention and the color photographic materials as described above, a fast process for color prints, which are usually used, is used but the present invention can be applied to an intelligent color hard copy requiring fast processing. In particular, in an intelligent color hard copy, a scanning light exposure using a high density light such as laser (e.g., semiconductor laser) or a light emitting diode can be preferably employed.

Semiconductor lasers usually have a high light sensitivity in the infrared region and hence a color photographic light-sensitive material being used for such a system can have at least one infrared light-sensitive silver halide emulsion layer in place of the aforesaid silver halide emulsion layer(s), when used in the method of the present invention.

By incorporating these light-sensitive emulsion layers wherein each silver halide emulsion has a sensitivity in each wavelength region and each of so-called color couplers forming each dye of a complementary color to each sensitizing light (i.e., yellow to blue, magenta to green, and cyan to red), a color reproduction by a subtractive color process can be practiced. In this case, the light-sensitive emulsion layers and the coloring hues of color couplers may employ other constituents than those described above.

Furthermore, according to the image quality required, two kinds of color couplers may be used and in this case, the number of silver halide emulsion layers corresponding to these couplers may be two. In this case, full color images are not obtained but color images can be formed faster.

According to the present invention, color photographic light-sensitive materials can be processed in a shorter period of time and also processed more stably in continuous processing than conventional methods.

Also, the present invention can provide a method for processing silver halide color photographic materials capable of giving both high storage stability of formed color images and the fast processing property. Also, in the present invention, a processing system giving less waste solutions with low replenisher processing is possible. Moreover, the use of 5-pyrazolone magenta couplers having an anion-releasing group at a coupling position or pyrazoloazole based magenta couplers as magenta couplers can be used to obtain color images having a high storage stability and, in particular, an excellent light fastness.

Then, the present invention is described in more detail by the following examples but is not limited thereto.

EXAMPLE 1

A multilayer color photographic paper having the layers shown below on a paper support, having polyethylene layer on both surfaces thereof, was prepared.

Coating compositions for the layers were prepared as follows.

Preparation of Coating Composition for the First Layer

In 8.2 g of a solvent (Solv-1, as described herein) were dissolved 19.1 g of a yellow coupler (ExY), 4.4 g of a color image stabilizer (Cpd-1), 0.7 g of a color image stabilizer (Cpd-7), and 27.2 ml of ethyl acetate and the solution thus prepared was emulsified and dispersed in 185 ml of an aqueous 10% gelatin solution containing 8 ml of an aqueous solution of 10% sodium dodecylbenzenesulfonate. On the other hand, a blue-sensitive sensitizing dye described below was added to a silver chlorobromide emulsion (cubic form, mean grain size: 0.88 $\mu m$, variation coefficient of the grain size distribution: 0.08, the silver halide grain had locally on the surface thereof 0.2 mol % silver bromide) in an amount of $2.0 \times 10^{-4}$ mol per mol of silver, a blue-sensitive sensitizing dye described below was also added to a silver chlorobromide emulsion (cubic form, mean grain size: 0.70 $\mu m$, variation coefficient of grain size distribution: 0.10, the silver halide grain had locally on the surface thereof 0.2 mol % silver bromide) in an amount of $2.5 \times 10^{-4}$ mol per mol of silver, the former emulsion was mixed with the latter emulsion at a ratio of 3/7 (by mol ratio of silver), and a sulfur sensitization was applied to the mixed emulsion. The aforesaid emulsified dispersion was mixed with the mixed emulsion and the composition of the mixture was adjusted as shown below to provide a coating composition for the first layer.

Coating compositions for the second layer to the seventh layer were prepared in a manner similar to the above.

For each layer was also used 1-oxy-3,5-dichloro-s-triazine sodium salt as a gelatin hardening agent.

Following dyes were used as spectral sensitizing dyes for each emulsion layer.

For Blue-Sensitive Emulsion Layer

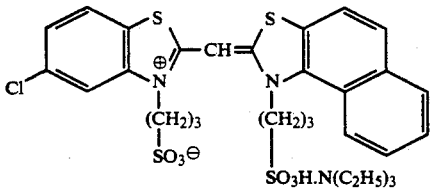

and

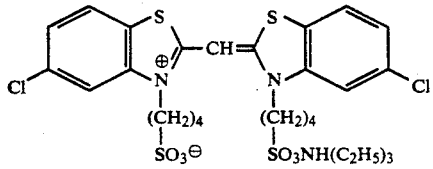

(each dye was added as $2.0\times10^{-4}$ mol for the silver halide emulsion of large grain size and $2.5\times10^{-4}$ mol for the silver halide emulsion of small grain size per mol of silver halide)

For Green-Sensitive Emulsion Layer

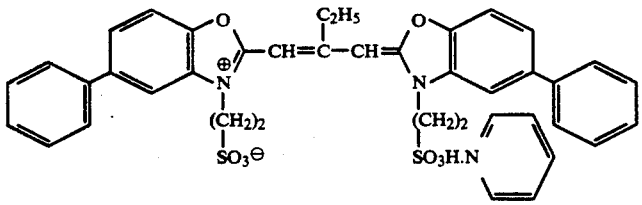

($4.0\times10^{-4}$ mol for the large grain size emulsion and $5.6\times10^{-4}$ mol for the small grain size emulsion per mol of silver halide), and

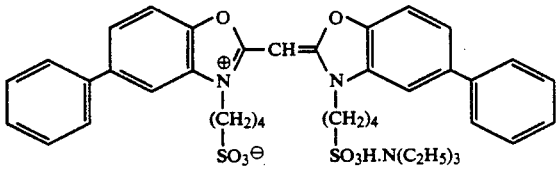

($7.0\times10^{-5}$ mol for the large grain size emulsion per mol of silver halide)

For Red-Sensitive Emulsion Layer

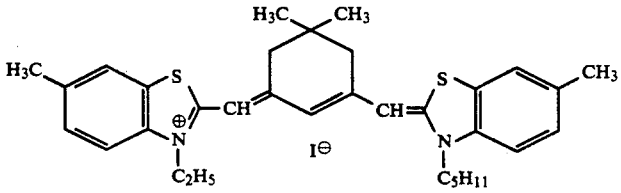

($0.9\times10^{-4}$ mol for the large grain size emulsion and $1.1\times10^{-4}$ mol for the small grain size emulsion per mol of silver halide)

Also, to the red-sensitive emulsion layer was added the compound shown below in an amount of $2.6\times10^{-3}$ mol per mol of silver halide:

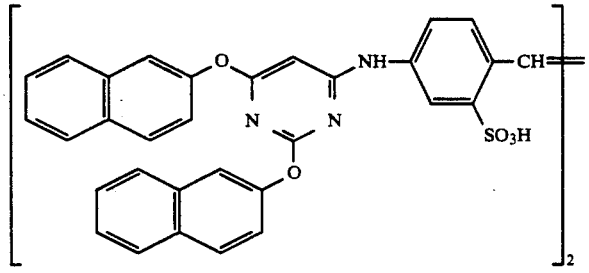

Also, to the blue-sensitive emulsion layer, the green-sensitive emulsion layer, and the red-sensitive emulsion layer was added 1-(5-methylureidophenyl)-5-mercaptotetrazole in the amounts of $8.5\times10^{-5}$ mol, $7.7\times10^{-4}$ mol, and $2.5\times10^{-4}$ mol, respectively, per mol of silver halide.

Furthermore, to the blue-sensitive emulsion layer and the green-sensitive emulsion layer was added 4-hydroxy-6-methyl-1,3,3a,7-tetraazaindene in the amounts of $1\times10^{-4}$ mol and $2\times10^{-4}$ mol, respectively, per mol of silver halide.

Also, to each emulsion layer were added the following dyes for irradiation prevention.

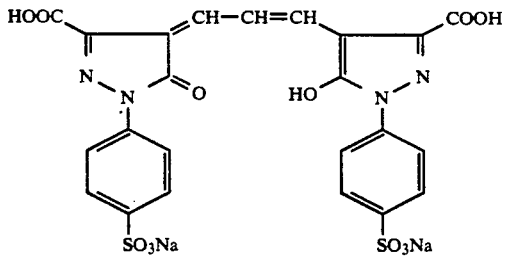

and

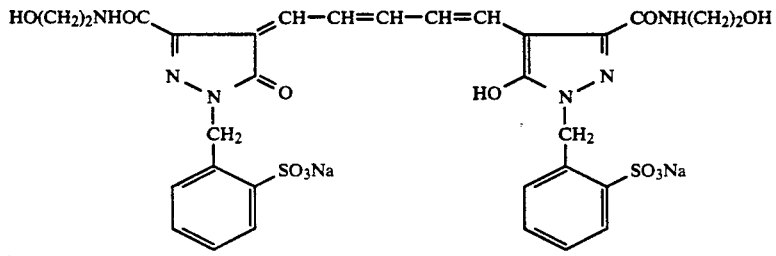

Layer Structure

The compositions of the layers are shown below. The numerals shown below are coating amounts (g/m$^2$), wherein the case of each silver halide emulsion is shown by the coated amount calculated as silver.

Support

Polyethylene Coated Paper (the polyethylene layer at the emulsion side on the support contained a white pigment ($TiO_2$) and a bluish dye (ultramarine blue))

| | |
|---|---|
| First Layer (Blue-Sensitive Emulsion Layer) | |
| Silver Chlorobromide Emulsion Shown Above | 0.30 |
| Gelatin | 1.86 |
| Yellow Coupler (ExY) | 0.82 |
| Color Image Stabilizer (Cpd-1) | 0.19 |
| Solvent (Solv-1, as shown herein) | 0.35 |
| Color Image Stabilizer (Cpd-7) | 0.06 |
| Second Layer (Color Mixing Inhibiting Layer) | |
| Gelatin | 0.99 |
| Color Mixing Inhibitor (Cpd-5) | 0.08 |
| Solvent (Solv-1, as shown herein) | 0.16 |
| Solvent (Solv-4, as shown herein) | 0.08 |
| Third Layer (Green-Sensitive Emulsion Layer) | |
| Silver Chlorobromide Emulsion (cubic, ⅓ mixture (mol ratio of Ag) of the silver halide grains of mean grain size of 0.55 μm and the silver halide grains of 0.39 μm, variation coefficients of grain size distributions of them: 0.10 and 0.08, each silver halide grain locally had on the surface thereof 0.8 mol % AgBr) | 0.12 |
| Gelatin | 1.24 |
| Magenta Coupler (ExM) | 0.20 |
| -continued | |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2, as shown herein) | 0.40 |
| Fourth Layer (Ultraviolet Absorbing Layer) | |
| Gelatin | 1.58 |
| Ultraviolet Absorber (UV-1) | 0.47 |
| Color Mixing Inhibitor (Cpd-5) | 0.05 |
| Solvent (Solv-5, as shown herein) | 0.24 |
| Fifth Layer (Red-Sensitive Emulsion Layer) | |
| Silver Chlorobromide Emulsion (cubic, ¼ mixture (mol ratio as Ag) of silver halide grains of mean grain size of 0.58 μm and silver halide grains of 0.45 μm, variation coefficients of grain size distributions: 0.09 and 0.11, each grain locally had on the surface 0.6 mol % AgBr) | 0.23 |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6, as shown herein) | 0.15 |
| Sixth Layer (Ultraviolet Absorbing Layer) | |
| Gelatin | 0.53 |
| Ultraviolet Absorber (UV-1) | 0.16 |
| Color Mixing Inhibitor (Cpd-5) | 0.02 |
| Solvent (Solv-5, as shown herein) | 0.08 |
| Seventh Layer (Protective Layer) | |
| Gelatin | 1.33 |
| Acryl Modified Copolymer of Polyvinyl Alcohol (modified degree: 17%) | 0.17 |
| Fluid Paraffin | 0.03 |

The compounds used for the color photographic paper were as follows.

(ExY) Yellow Coupler:

-continued
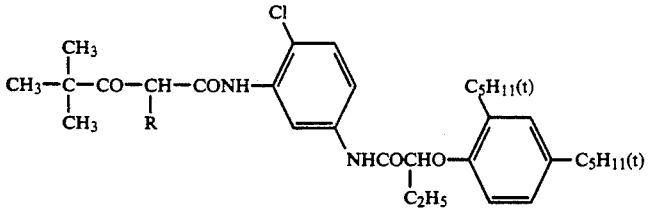
A 1/1 mixture (molar ratio) of
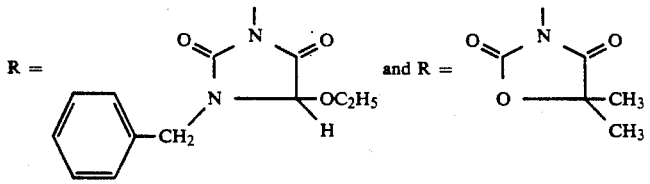
(ExM) Magenta Coupler:
A 1/1 mixture (molar ratio) of
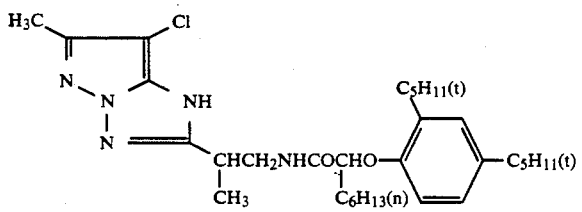
and
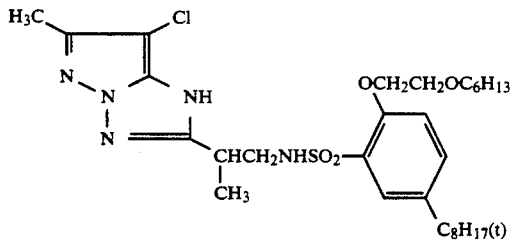
(ExC) Cyan Coupler:
A 2:4:4 mixture by weight of
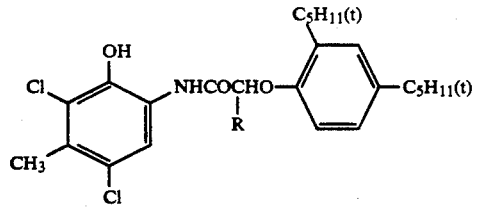
wherein R = $C_2H_5$ and $C_4H_9$
and
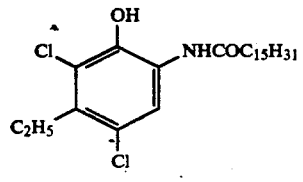
(Cpd-1) Color Image Stabilizer:

-continued
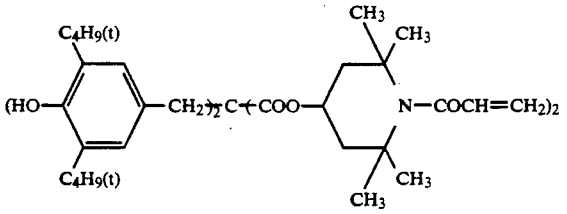
(Cpd-2) Color Image Stabilizer:
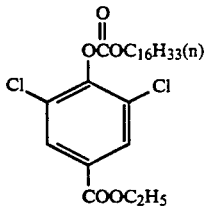
(Cpd-3) Color Image Stabilizer:
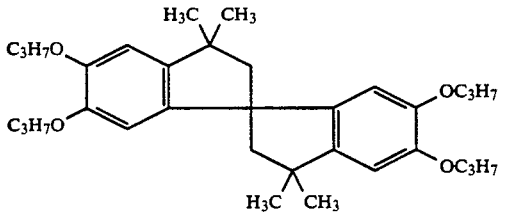
(Cpd-4) Color Image Stabilizer:
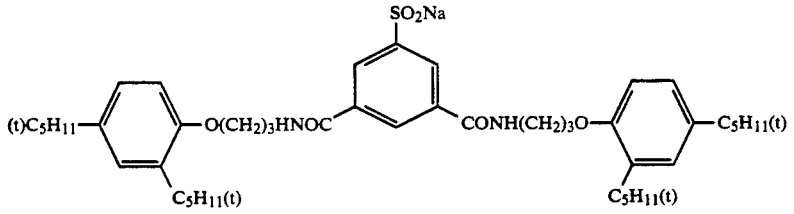
(Cpd-5) Color Mixing Inhibitor:
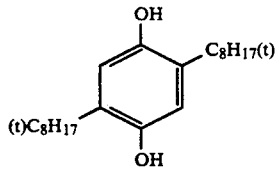
(Cpd-6) Color Image Stabilizer:
A 2/4/4 mixture (by weight) of
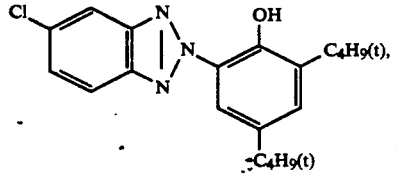
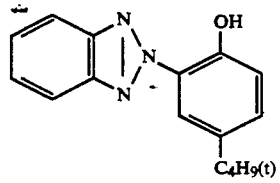

-continued
and
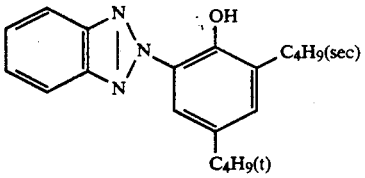
(Cpd-7) Color Image Stabilizer:
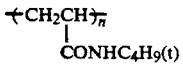
(average molecular weight: 60,000)
(Cpd-8) Color Image Stabilizer:
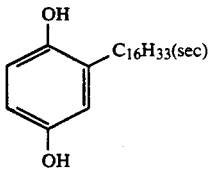
(Cpd-9) Color Image Stabilizer:
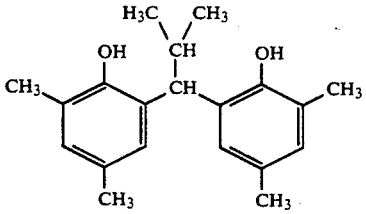
(UV-1) UV Absorber:
A 4/2/4 mixture (by weight) of
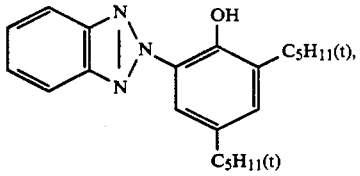
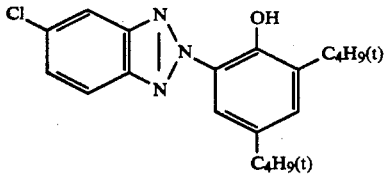
and
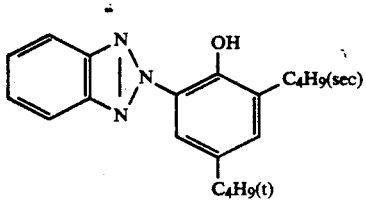
(Solv-1) Solvent:

-continued

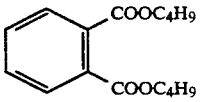

(Solv-2) Solvent:
A 2/1 mixture (by volume) of

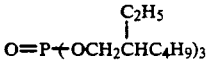

and

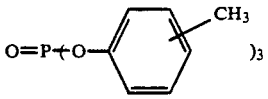

(Solv-3) Solvent:
$O{=}P{+}OC_9H_{19}(iso)]_3$
(Solv-4) Solvent:

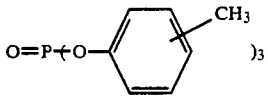

(Solv-5) Solvent:

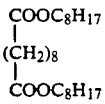

(Solv-6) Solvent:

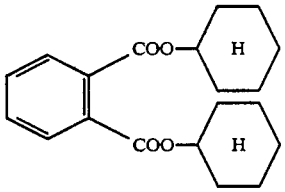

(Solv-7) Solvent:

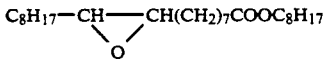

First, the sample thus prepared was subjected to a gradation exposure through a sensitometric trichromatic separation filter using an actinometer (Type FWH, manufactured by Fuji Photo Film Co., Ltd., color temperature of light source: 3,200° K.). In this case, the exposure was carried out such that the exposure amount became 250 CMS in an exposure time of 0.1 second.

The sample thus exposed was processed by the following processing steps using the processing solutions having the compositions shown below.

In this case, however, the kind of the color developing agent was changed as shown in Table 1 below.

| Processing Step | Temperature (°C.) | Time (sec) |
|---|---|---|
| Color Developing | 42 | 10 |
| Blixing | 35–40 | 10 |
| Washing | 30–35 | 10 |
| Stabilizing | 30–35 | 10 |

-continued

| Processing Step | Temperature (°C.) | Time (sec) |
|---|---|---|
| Drying | 70–80 | 20 |

The compositions of the processing solutions were as follows.

| | Tank Liquid |
|---|---|
| Color Developer | |
| Water | 800 ml |
| Ethylenediamine-N,N,N',N'-tetra methylenesulfonic Acid | 1.5 g |
| Potassium Bromide | 0.015 g |
| Triethanolamine | 8.0 g |
| Sodium Chloride | 1.4 g |
| Potassium Carbonate | 25 g |
| Color Developing Agent (shown in Table 1) | 12 mmol |
| Diethylhydroxylamine (80% aq. soln.) | 4.5 g |

-continued

| | Tank Liquid |
|---|---|
| Optical Whitening Agent (Whitex 4B, trade name, made by Sumitomo Chemical Co., Ltd.) | 1.0 g |
| Water to make | 1,000 ml |
| pH (25° C.) | 10.05 |
| Blixing Solution (composition of the tank liquid was the same as that of the replenisher) | |
| Water | 400 ml |
| Ammonium Thiosulfate | 100 g |
| Sodium Sulfite | 17 g |
| Ethylenediaminetetraacetic Acid Iron(III) Ammonium | 55 g |
| Disodium Ethylenediaminetetraacetate | 5 g |
| Ammonium Bromide | 40 g |
| Water to make | 1,000 ml |
| pH (25° C.) | 6.0 |
| Washing Water | |
| City Water | |
| Stabilizing Solution | |
| 5-Chloro-2-methyl-4-isothiazolin-3-one | 0.02 g |
| 2-Methyl-4-isothiazolin-3-one | 0.01 g |
| Hydroxyethylene-1,1-diphosphonic Acid (60% aqueous solution) | 12 g |
| Water to make | 1,000 ml |
| pH (25° C.) | 4.0 to 7.0 |

On each of the yellow, magenta, and cyan color images thus obtained, the minimum density (Dmin) and the maximum density (Dmax) were measured through each of blue (B), green (G), and red (R) filters corresponding to the dyes.

Then, the samples were exposed to a xenon lamp (300,000 lux) for 8 days and thereafter the reduction of the image densities after the light irradiation was measured. (Shown by the density after light irradiation of the images at the exposure amount portion of giving FD: image density of 1.0. FD: density after light fading.)

The results are shown in Table 1.

As the result of the investigations while changing the structure of p-phenylenediamine derivatives shown in Table 1 above, it can be seen that the only compounds of the present invention give sufficient Dmax and color images having a high light fastness by the fast processing of 10 seconds.

Then, color photographic materials were prepared in the same manner as for the above described color photographic materials but changing the halogen composition in the silver halide emulsions used in the emulsion layers to those set forth below.

First Layer (Blue-Sensitive Emulsion Layer)

Silver chlorobromide emulsion (⅓ mixture (mol ratio of Ag) of cubic silver chlorobromide containing 80.0 mol % of AgBr and having mean grain size of 0.85 μm and variation coefficient of 0.08 and cubic silver chlorobromide containing 80.0 mol % AgBr and having mean grain size of 0.62 μm and variation coefficient of 0.07)

Third Layer (Green-Sensitive Emulsion Layer)

Silver chlorobromide emulsion (1/1 mixture (mol ratio of Ag) of cubic silver chlorobromide containing 90 mol % of AgBr and having mean grain size of 0.47 μm and variation coefficient of 0.12 and cubic silver chlorobromide containing 90 mol % AgBr and having mean grain size of 0.36 μm and variation coefficient of 0.09)

Fifth Layer (Red-Sensitive Emulsion Layer)

Silver chlorobromide emulsion (½ mixture (mol ratio of Ag) of cubic silver chlorobromide containing 70 mol % of AgBr and having mean grain size of 0.49 μm and variation coefficient of 0.08 and cubic silver chlorobromide containing 70 mol % AgBr and having mean grain size of 0.34 μm and variation coefficient of 0.10)

Then, the similar light fastness test was conducted on the photographic papers with varied color developing conditions. That is, the above described developing

TABLE 1

| Sample No. | Substituents of the Color Developing Agent Shown Below* | | | Dmax | | | Dmin | | | FD | | |
|---|---|---|---|---|---|---|---|---|---|---|---|---|
| | $R_{11}$ | $R_{12}$ | $R_{13}$ | B | G | R | B | G | R | B | G | R |
| 1 (Control) | $CH_3$ | $C_2H_5$ | $C_2H_4NHSO_2CH_3$ | 0.52 | 1.90 | 2.40 | 0.07 | 0.06 | 0.12 | 0.87 | 0.83 | 0.80 |
| 2 (Invention) | $CH_3$ | $C_2H_5$ | $C_3H_6OH$ | 2.09 | 2.45 | 2.48 | 0.09 | 0.07 | 0.13 | 0.78 | 0.85 | 0.83 |
| 3 (Invention) | $CH_3$ | $C_2H_5$ | $C_4H_8OH$ | 2.00 | 2.47 | 2.50 | 0.08 | 0.06 | 0.12 | 0.84 | 0.90 | 0.87 |
| 4 (Comparison) | $CH_3$ | $C_3H_7$ | $C_2H_4OH$ | 1.81 | 2.40 | 2.50 | 0.09 | 0.06 | 0.13 | 0.58 | 0.49 | 0.66 |
| 5 (Comparison) | $CH_3$ | $C_2H_5$ | $C_5H_{10}OH$ | 0.95 | 2.00 | 2.43 | 0.07 | 0.06 | 0.12 | 0.76 | 0.82 | 0.80 |
| 6 (Comparison) | $CH_3$ | $C_2H_4OCH_3$ | $C_2H_4OH$ | 0.30 | 1.55 | 2.40 | 0.06 | 0.06 | 0.12 | 0.75 | 0.66 | 0.73 |
| 7 (Comparison) | $C_2H_4NHSO_2CH_3$ | $C_2H_5$ | $C_2H_5$ | 0.53 | 2.00 | 2.43 | 0.07 | 0.06 | 0.12 | 0.71 | 0.49 | 0.73 |
| 8 (Comparison) | $CH_3$ | $C_2H_5$ | $C_2H_4OCH_3$ | 0.15 | 1.95 | 2.52 | 0.06 | 0.06 | 0.13 | 0.59 | 0.73 | 0.76 |
| 9 (Comparison) | H | $C_2H_5$ | $C_2H_5$ | 0.32 | 1.52 | 1.95 | 0.06 | 0.06 | 0.11 | 0.31 | 0.46 | 0.67 |
| 10 (Comparison) | $CH_3$ | $C_2H_4OCH_3$ | $C_2H_4OCH_3$ | 0.12 | 1.45 | 1.80 | 0.06 | 0.06 | 0.10 | 0.62 | 0.77 | 0.76 |
| 11 (Comparison) | H | $C_2H_4OH$ | $C_2H_4OH$ | 0.15 | 0.80 | 0.95 | 0.06 | 0.06 | 0.07 | 0.67 | 0.08 | 0.54 |

*Sulfonate or p-toluenesulfonate of

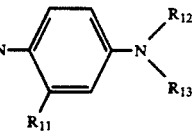

conditions were followed but changing the color developing agent in the above described color developer to those indicated in Table 1(2) below and effecting the development at 37° C. for 3 minutes 30 seconds.

The samples thus obtained were exposed to a xenon lamp (300,000 lux) for 8 days, and thereafter the reduction of the image densities after the light irradiation was measured. (Shown by the density after light irradiation of the images at the exposure amount portion of giving FD:image density of 1.0. FD: density after light fading.)

The results are shown in Table 1(2).

TABLE 1(2)

| Sample No. | Color Developing Agent | FD B | FD G | FD R |
|---|---|---|---|---|
| Comparison-1 | 4-Amino-3-methyl-N-ethyl-N-[β-(methanesulfonamido)ethyl]-aniline.3/2sulfate.monohydrate | 0.80 | 0.75 | 0.72 |
| Comparison-2 | 4-Amino-3-methyl-N-ethyl-N-(β-hydroxyethyl)aniline.sulfate | 0.57 | 0.45 | 0.60 |
| Comparison-3 | 4-Amino-3-methyl-N-ethyl-N-(3-hydroxypropyl)aniline.2.p-toluenesulfonic acid | 0.61 | 0.57 | 0.69 |
| Comparison-4 | 4-Amino-3-methyl-N-ethyl-N-(4-hydroxybutyl)aniline.2.p-toluenesulfonic acid | 0.65 | 0.61 | 0.72 |

It is apparent from the results in Table 1(2) that when a conventional silver chlorobromide emulsion having a high silver bromide content is used and color development is carried out for a long period of time, the light fastness cannot particularly be improved even if the color developing agent disclosed in the present invention is used.

When the period of color developing time in this processing was shortened to 2 minutes and even to 1 minute, the results were about, the same as shown above.

EXAMPLE 2

A color photographic paper having the same layer structures as in Example 1 was prepared and processed by the following processing steps.

First, the sample was subjected to a gradation exposure through a sensitometric trichromatic separation filter using an actinometer (Type FWH, manufactured by Fuji Photo Film Co., Ltd., color temperature of light source: 3,200° K.). In this case, the exposure was carried out such that the exposure amount for an exposure time of 0.1 second was 250 CMS.

The sample thus exposed was continuously processed (running test) using the following processing steps and processing solutions until the replenisher for the color developer became correspondent to the same volume as that of the developer tank. In this case, however, the composition of the color developer and the developing time were changed as shown in Table 2 below in the processing.

| Processing Stage | Temperature (°C.) | Time (sec) | Replenisher* (ml) | Tank Volume (liter) |
|---|---|---|---|---|
| Color Developer | 35 | 10–30 | 60 | 2 |
| Blixing | 30–35 | 20 | 60 | 2 |
| Rinsing (1) | 30–35 | 10 | — | 1 |
| Rinsing (2) | 30–35 | 10 | — | 1 |
| Rinsing (3) | 30–35 | 10 | 120 | 1 |
| Drying | 70–80 | 20 | | |

*The replenisher amount was expressed per square meter of the color photographic paper (Three tank countercurrent system of from rinsing (3) to rinsing (1))

The compositions of the processing solutions were as follows.

| | Tank Liquid | Replenisher |
|---|---|---|
| Color Developer: | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 3.2 g | — |
| Potassium Carbonate | 25 g | 37 g |
| Color Developing Agent (shown in Table 2) | (shown in Table 2) | |
| N,N-bis(Carboxymethyl)hydrazine | 5.5 g | 7.0 g |
| Optical Whitening Agent (WHITEX 4B, trade name, made by Sumitomo Chemical Co., Ltd.) | 1.0 g | 2.0 g |
| Water to make | 1,000 ml | 1,000 ml |
| pH (25° C.) | 10.05 | 10.45 |
| Blixing Solution (the composition of tank liquid was the same as that of the replenisher) | | |
| Water | 400 ml | |
| Ammonium Thiosulfate (70%) | 100 ml | |
| Sodium Sulfite | 17 g | |
| Ethylenediaminetetraacetic Acid Iron(III) Ammonium | 55 g | |
| Disodium Ethylenediaminetetraacetate | 5 g | |
| Ammonium Bromide | 40 g | |
| Water to make | 1,000 ml | |
| pH (25° C.) | 6.0 | |
| Rinsing Solution (the composition of tank liquid was the same as that of the replenisher) | | |
| Ion-Exchanged Water (the content of each of calcium and magnesium was less than 3 ppm) | | |

By applying the aforesaid sensitometry at the start and the end of the running test, the density of each of the yellow, magenta, and cyan color images was measured through each of a blue, green, and red filters corresponding to each dye and the minimum density (Dmin), the maximum density (Dmax), and the relative sensitivity (S: a relative value when the sensitivity of Sample 2 at 30 seconds was defined to be 100) were calculated.

Also, the change of the relative sensitivity (ΔS) in 30 seconds of the development time before and after the running processing was determined.

Then, the sample obtained by processing of the development time of 30 seconds was exposed to a xenon lamp (300,000 lux) and thereafter the reduction of the image density by the light irradiation was measured (shown by the density after the light irradiation of the images at the exposure amount portion of giving FD:image density of 1.0. FD: Density after light fading).

These results are shown in Table 2 below.

TABLE 2

Amount

TABLE 2-continued

| Sample No. | Color Developing Agent | Amount in Tank Liquid (g/liter) | in Replenisher (g/liter) | Time (sec) | B Dmin | B Dmax | B S | B ΔS | B FD |
|---|---|---|---|---|---|---|---|---|---|
| 12 (Comparison) | 4-Amino-3-methyl-N-ethyl-N-[β-methanesulfonamido)-ethyl]aniline. 3/2 sulfate. monohydrate | 7.5 (17 mmol) | 12.8 | 10 | 0.08 | 0.26 | 3 | — | — |
| | | | | 20 | 0.09 | 1.54 | 63 | — | 0.89 |
| | | | | 30 | 0.09 | 2.00 | 79 | 10 | 0.89 |
| 13 (Comparison) | 4-Amino-3-methyl-N-ethyl-N-(β-hydroxyethyl)aniline. sulfate | 5.0 (17 mmol) | 8.6 | 10 | 0.08 | 1.10 | 38 | — | 0.66 |
| | | | | 20 | 0.09 | 2.14 | 85 | — | 0.63 |
| | | | | 30 | 0.09 | 2.14 | 100 | 5 | 0.63 |
| 14 (Invention) | 4-Amino-3-methyl-N-ethyl-N-(3-hydroxypropyl)aniline. 2.p-toluenesulfonic acid | 9.4 (17 mmol) | 16.1 | 10 | 0.09 | 1.26 | 25 | — | 0.82 |
| | | | | 20 | 0.10 | 2.18 | 93 | — | 0.79 |
| | | | | 30 | 0.10 | 2.18 | 105 | 5 | 0.79 |
| 15 (Invention) | 4-Amino-3-methyl-N-ethyl-N-(4-hydroxybutyl)aniline. naphthalene-1,5-disulfonic acid | 8.7 (17 mmol) | 14.8 | 10 | 0.09 | 1.05 | 42 | — | 0.86 |
| | | | | 20 | 0.09 | 2.20 | 105 | — | 0.84 |
| | | | | 30 | 0.09 | 2.20 | 110 | 5 | 0.84 |

| Sample No. | G Dmin | G Dmax | G S | G ΔS | G FD | R Dmin | R Dmax | R S | R ΔS | R FD |
|---|---|---|---|---|---|---|---|---|---|---|
| 12 (Comparison) | 0.06 | 1.50 | 20 | — | 0.85 | 0.12 | 2.18 | 69 | — | 0.81 |
| | 0.06 | 2.40 | 76 | — | 0.83 | 0.13 | 2.50 | 85 | — | 0.80 |
| | 0.07 | 2.40 | 87 | 10 | 0.83 | 0.13 | 2.50 | 89 | 20 | 0.80 |
| 13 (Comparison) | 0.06 | 2.40 | 79 | — | 0.51 | 0.12 | 2.54 | 85 | — | 0.67 |
| | 0.06 | 2.44 | 94 | — | 0.50 | 0.13 | 2.54 | 96 | — | 0.66 |
| | 0.07 | 2.44 | 100 | 5 | 0.50 | 0.13 | 2.54 | 100 | 7 | 0.66 |
| 14 (Invention) | 0.06 | 2.42 | 78 | — | 0.85 | 0.13 | 2.45 | 82 | — | 0.85 |
| | 0.07 | 2.50 | 95 | — | 0.85 | 0.13 | 2.45 | 91 | — | 0.83 |
| | 0.07 | 2.50 | 102 | 5 | 0.85 | 0.13 | 2.45 | 98 | 7 | 0.83 |
| 15 (Invention) | 0.06 | 2.48 | 85 | — | 0.90 | 0.12 | 2.52 | 92 | — | 0.88 |
| | 0.06 | 2.48 | 108 | — | 0.90 | 0.13 | 2.52 | 110 | — | 0.87 |
| | 0.07 | 2.48 | 118 | 5 | 0.90 | 0.13 | 2.52 | 125 | 5 | 0.87 |

It can be seen from the results shown in Table 2 that in the case of using the color developing agent in Sample No. 12, which is conventionally used for developing color photographic papers, the density of the lowermost blue-sensitive emulsion layer (BL) is insufficient using a processing time of 30 seconds and also the deviation of sensitivity before and after running processing is large (Sample No. 12). Also, in the color developing agent in Sample No. 13, fast development and the running of the processing with less deviation of sensitivity can be attained, but the light fastness of color images formed is deteriorated.

On the other hand, in the case of using a color developing agent according to the method of the present invention, color images having high Dmax and a high light fastness are obtained even in processing of a short time, such as 30 seconds or less.

These results are obtained in a system that uses a high silver chloride-containing silver halide emulsion, but in the case of color photographic materials using a low silver chloride-containing silver halide emulsion (80% or less of silver chloride), desired Dmax and sensitivity are not obtained even by the processing of 60 seconds even by using any color developing agent. Also, when a color developer containing benzyl alcohol is used, development delay is observed in the lowermost emulsion layer (BL).

EXAMPLE 3

The same procedure as in Example 2 was followed except that the color developing agent in the color developer was changed as shown in Table 3 below and the developing time was changed to 20 seconds.

As the result thereof, it can be seen that when color photographic papers are processed according to the process of the present invention, the fast and stabilized processing are attained and also color images having excellent storage stability are obtained.

TABLE 3

| Sample No. | Color Developing Agent | B Dmin | B Dmax | B S | B ΔS | B FD | G Dmin | G Dmax | G S | G ΔS | G FD | R Dmin | R Dmax | R S | R ΔS | R FD |
|---|---|---|---|---|---|---|---|---|---|---|---|---|---|---|---|---|
| 16 | Compound 1 4-Amino-3-methyl-N-methyl-N-(3-hydroxypropyl)aniline | 0.10 | 2.18 | 105 | 5 | 0.76 | 0.07 | 2.49 | 100 | 5 | 0.83 | 0.13 | 2.44 | 100 | 7 | 0.82 |

TABLE 3-continued

| Sample No. | Color Developing Agent | B | | | | | G | | | | | R | | | | |
|---|---|---|---|---|---|---|---|---|---|---|---|---|---|---|---|---|
| | | Dmin | Dmax | S | ΔS | FD | Dmin | Dmax | S | ΔS | FD | Dmin | Dmax | S | ΔS | FD |
| 17 | Compound 3 4-Amino-3-methyl-N-ethyl-N-(2-hydroxy-propyl)aniline | 0.09 | 2.10 | 100 | 5 | 0.74 | 0.07 | 2.42 | 98 | 5 | 0.81 | 0.13 | 2.44 | 100 | 8 | 0.80 |
| 18 | Compound 4 4-Amino-3-methyl-N-ethyl-N-[2-hydroxy-(1-methyl)-ethyl]aniline | 0.09 | 2.11 | 100 | 5 | 0.74 | 0.07 | 2.42 | 98 | 5 | 0.80 | 0.13 | 2.45 | 100 | 7 | 0.80 |
| 19 | Compound 5 4-Amino-3-ethyl-N-methyl-N-(3-hydroxy-propyl)aniline | 0.10 | 2.10 | 107 | 3 | 0.76 | 0.07 | 2.50 | 102 | 3 | 0.81 | 0.13 | 2.48 | 103 | 5 | 0.81 |
| 20 | Comound 11 4-Amino-3-methyl-N-propyl-N-(4-hydroxy-butyl)aniline | 0.10 | 2.10 | 105 | 5 | 0.84 | 0.07 | 2.45 | 105 | 5 | 0.91 | 0.13 | 2.45 | 112 | 7 | 0.88 |
| 21 | Compound 15 4-Amino-3-methyl-N-ethyl-N-(3-hydroxy-butyl)aniline | 0.10 | 2.13 | 107 | 4 | 0.83 | 0.07 | 2.50 | 108 | 4 | 0.90 | 0.13 | 2.49 | 115 | 6 | 0.86 |

The above compounds were all used in the form of p-toluenesulfonates.

EXAMPLE 4

Preparation of Emulsion

To an aqueous 3% solution of lime-processed gelatin was added 3.3 g of sodium chloride and then was added 3.2 ml of an aqueous 1% solution of N,N'-dimethylimidazolidine-2-thione. To the aqueous solution were added an aqueous solution containing 0.2 mol of silver nitrate and an aqueous solution containing 0.2 mol of sodium chloride and 15 μg of rhodium trichloride with stirring vigorously at 56° C. Then, an aqueous solution containing 0.780 mol of silver nitrate and an aqueous solution containing 0.780 mol of sodium chloride and 4.2 mg of potassium ferrocyanide were added to the mixture with stirring vigorously at 56° C. Five minutes after completion of the addition of the aqueous silver nitrate solution and the aqueous alkali halide solution, an aqueous solution containing 0.020 mol of silver nitrate and an aqueous solution containing 0.015 mol of potassium bromide, 0.005 mol of sodium chloride, and 0.8 mg of potassium hexachloroiridate(IV) were added to the mixture with stirring vigorously at 40° C.

Thereafter, the mixture was desalted and washed with water. Furthermore, 90.0 g of lime-processed gelatin was added to the mixture, and after further adding thereto triethylthiourea, a chemical sensitization was most suitably applied thereto to provide a silver chlorobromide emulsion (A)

On the silver chlorobromide emulsion (A) thus obtained, the form of the silver halide grains, the grain sizes, and the grain size distribution thereof were determined from the electron microphotographs thereof.

The results showed that the silver halide grains were all cubic, the mean grain size was 0.52 μm, and the coefficient of variation of the grain size distribution was 0.08. The mean grain size was shown by the mean value of the diameters of circles equivalent to the projected areas of the grains and the variation coefficient of the grain size distribution was shown by the value obtained by dividing the standard deviation of the grain sizes by the mean grain size.

Then, from the X-ray diffraction of the silver halide crystals, the halogen composition of the silver halide grains was determined. By using the monochromatic CuKα line as the X-ray source, the diffraction angles from the (200) plane were measured in detail. The diffraction line from the silver halide crystals having a uniform halogen composition gave a simple peak, while the diffraction line from the silver halide crystals having a local phase having a different halogen composition gave plural peaks corresponding to these compositions. By calculating the lattice constant from the measured diffraction angles of the peaks, the halogen composition of silver halide constituting the silver halide crystals was determined.

In the measurement results for the silver halide emulsion (A), in addition to the main peak for 100% silver chloride, a broad diffraction pattern having a center for 70% silver chloride (30% silver bromide) and trains extending to about 60% silver chloride (40% silver bromide) was observed.

Preparation of Color Photographic Paper

A multilayer color photographic paper having the layers shown below on a paper support having polyethylene coating on both sides. The coating compositions for the layers were prepared as follows.

Preparation of Coating Composition for the First Layer

In a mixed solvent of 27.2 ml of ethyl acetate and 8.2 g of a solvent (Solv-1, as shown herein) were dissolved 19.1 g of a yellow coupler (ExY) and 4.4 g of a color image stabilizer (Cpd-1), and the solution obtained was emulsified and dispersed in 185 ml of an aqueous 10% gelatin solution containing 8 ml of an aqueous 10% solution of sodium dodecylbenzenesulfonate. Also, a silver halide emulsion was prepared by adding a red-sensitive sensitizing dye (Dye-1) to the aforesaid silver chlorobromide emulsion (A). The aforesaid emulsified dispersion was mixed with the silver halide emulsion and the composition of the mixture was adjusted as shown below to provide a coating composition for the first layer.

The coating compositions for the second layer to the seventh layer were also prepared by the similar manner to the above. In addition, 1-oxy-3,5-dichloro-s-triazine sodium salt was used as a gelatin hardening agent for each layer.

The following dyes were used as spectral sensitizing dyes for each layer.

For Red-Sensitive Yellow Coloring Layer (First Layer)

Dye 1:

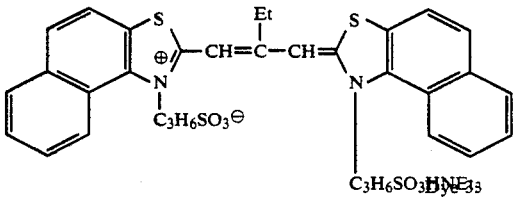

1.0 × $10^{-4}$ mol per mol of silver halide
and

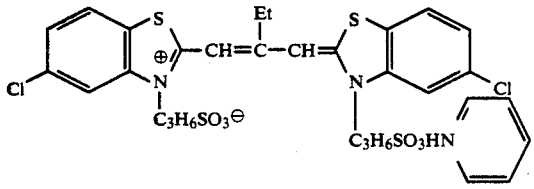

-continued 1.0 × $10^{-4}$ mol per mol of silver halide

For Infrared-Sensitive Magenta Coloring Layer (Third Layer)

Dye 2:

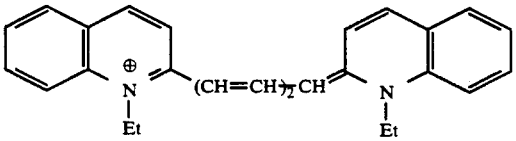

4.5 × $10^{-5}$ mol per mol of silver halide

For Infrared-Sensitive Cyan Coloring Layer (Fifth Layer)

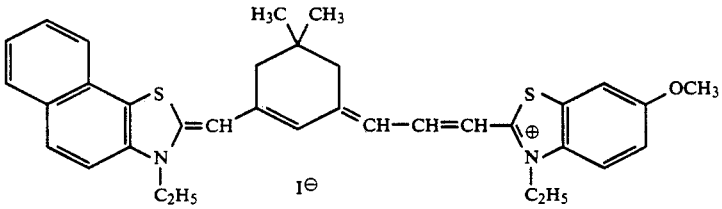

0.5 × $10^{-5}$ mol per mol of silver halide

Also, in the case of using (Dye-2) and (Dye-3), as shown above, the compound shown below was added together in an amount of $1.8\times10^{-3}$ mol per mol of silver

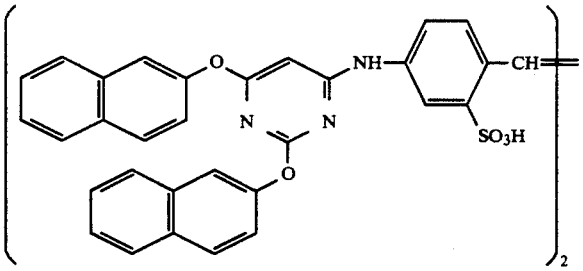

Also, to each of the yellow coloring emulsion layer, the magenta coloring emulsion layer, and the cyan coloring emulsion layer was added 1-(5-methylureidophenyl)-5-mercaptotetrazole in an amount of $8.0\times10^{-4}$ mol per mol of silver halide.

Furthermore, the dyes shown below were added to each emulsion layer for irradiation prevention.

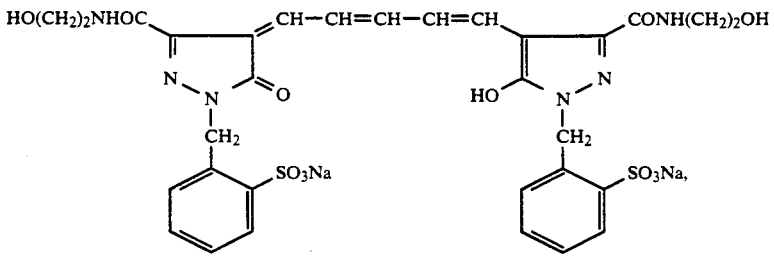

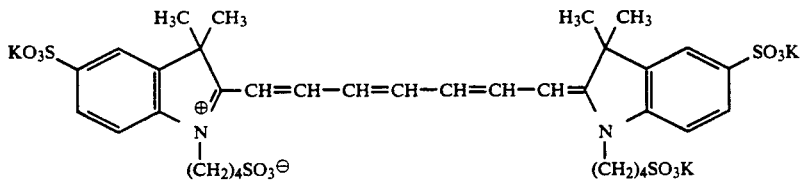

and

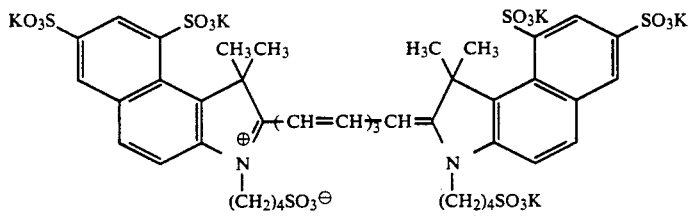

Layer Structure

The compositions of the layers are shown below. The numerals are coating amounts (g/m$^2$), wherein the case of silver halide emulsion is shown by the coating amount calculated as silver.

Support

Polyethylene Coated Paper (the polyethylene layer at the emulsion layer side on the support contained a white pigment ($TiO_2$) and a bluish dye (ultramarine blue))

| | |
|---|---|
| First Layer (Red-Sensitive Yellow Coloring Layer) | |
| Silver Chlorobromide Emulsion (A) Described Above | 0.30 |
| Gelatin | 1.86 |
| Yellow Coupler (ExY) | 0.82 |
| Color Image Stabilizer (Cpd-1) | 0.19 |
| Solvent (Solv-1) | 0.35 |
| Color Image Stabilizer (Cpd-7) | 0.06 |
| Second Layer (Color Mixing Inhibiting Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Infrared-Sensitive Magenta Coloring Layer) | |
| Silver Chlorobromide Emulsion (A) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer) | |
| Gelatin | 1.58 |
| Ultraviolet Absorber (UV-1) | 0.47 |
| Color Mixing Inhibitor (Cpd-5) | 0.05 |
| Solvent (Solv-5) | 0.24 |
| Fifth Layer (Infrared-Sensitive Cyan Coloring Layer) | |

-continued

| | |
|---|---|
| Silver Chlorobromide Emulsion (A) | 0.23 |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer (Ultraviolet Absorbing Layer) | |
| Gelatin | 0.53 |
| Ultraviolet Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.33 |
| Acryl Modified Copolymer of Polyvinyl Alcohol (modified degree: 17%) | 0.17 |
| Fluid Paraffin | 0.03 |

Then, a scanning exposure apparatus capable of exposing a color photographic paper by successively scanning by a semiconductor laser AlGaInP (oscillation wavelength: about 670 nm), a semiconductor laser GaAlAs (oscillation wavelength: about 750 nm), and a semiconductor laser GaAlAs (oscillation wavelength: about 810 nm) such that the laser light struck the color photographic paper traveling in the direction perpendicular to the scanning direction of the laser lights from a rotary polyhedron was prepared, and the color photographic papers were exposed using this apparatus. The exposure amounts were controlled by electrically controlling the exposure time and the light emitting amount of the semiconductor lasers.

The samples thus exposed were processed by the following processing steps, using the processing solutions having the compositions shown below.

In this case, however, the samples were processed while changing the type of color developer as shown in Table 4.

| Processing Step | Temperature (°C.) | Time (sec) |
|---|---|---|
| Color Developer | 38 | 15 |
| Blixing | 30–35 | 15 |
| Rinsing (1) | 30–35 | 7 |
| Rinsing (2) | 30–35 | 7 |
| Rinsing (3) | 30–35 | 7 |
| Rinsing (4) | 30–35 | 7 |
| Drying | 60–70 | 15 |

(Four tank countercurrent system of from rinsing (4) to rinsing (1).)

The compositions of the processing solutions used are as set forth below.

| | Tank Liquid |
|---|---|
| Color Developer: | |
| Water | 800 ml |
| 1-Hydroxyethylidene-1,1-diphosphonic Acid | 0.5 g |
| Diethylenetriaminepentaacetic Acid | 1.0 g |
| N,N,N-Trimethylenephosphonic Acid | 1.5 g |
| Potassium Bromide | 0.015 g |
| Triethanolamine | 8.0 g |
| Sodium Chloride | 4.9 g |
| Potassium Carbonate | 40 g |
| Sodium Hydrogencarbonate | 3.9 g |
| Color Developing Agent (shown in Table 4 below) | 24 mmols |
| N,N-bis(2-Sulfoethyl)hydroxylamine | 8.5 g |
| Optical Whitening Agent (Whitex 4B, trade name, made by Sumitomo Chemical Co., Ltd.) | 1.0 g |
| Water to make | 1,000 ml |
| pH (25° C.) | 10.15 |
| Blixing Solution: (The composition of the replenisher was the same as that of the tank liquid.) | |
| Water | 400 ml |
| Ammonium Thiosulfate (70%) | 100 ml |
| Ammonium Sulfite | 15 g |
| Ethylenediaminetetraacetic Acid Iron(III) Ammonium | 77 g |
| Disodium Ethylenediaminetetraacetate | 5 g |
| Ammonium Bromide | 40 g |
| Water to make | 1,000 ml |
| pH (25° C.) | 6.2 |
| Rinsing Solution: (The composition of the replenisher was the same as that of the tank liquid.) | |
| City Water | |

The rinsing (3) liquid was sent under pressure using a plastic pressure resisting vessel apparatus Type PV-0321, manufactured by Daicel Chemical Industries, Ltd., equipped with an inverse osmosis membrane (Spiral Type RO Module Element DRA-80, made by the aforesaid company, polysulfone series composite film, effective film area: 1.1 $m^2$) under the conditions of a liquid sending pressure of 4 $kg/cm^2$ and a flow rate of 1.5 liters/min. The liquid thus osmosed was supplied to the rinsing tank (4) and the concentrated liquid was returned to the rinsing tank (3).

The results are shown in Table 4 below.

TABLE 4

| Sample No. | Color Developing Agent | Dmax B | Dmax G | Dmax R | FD B | FD G | FD R |
|---|---|---|---|---|---|---|---|
| 22 | Compound 2 | 2.15 | 2.35 | 2.41 | 0.78 | 0.85 | 0.82 |
| 23 | Compound 6 | 2.10 | 2.29 | 2.35 | 0.76 | 0.85 | 0.84 |
| 24 | Compound 11 | 2.14 | 2.35 | 2.40 | 0.85 | 0.90 | 0.87 |
| 25 | Compound 12 | 2.10 | 2.30 | 2.37 | 0.83 | 0.90 | 0.89 |

Dmin was omitted since no difference existed among the samples.

From the results shown in Table 4, it can be seen that by processing a color photographic material exposed by laser using a color developing agent in the method of the present invention, color images having sufficient Dmax and a high light fastness were obtained in processing of a short time, such as 30 seconds or less.

Thus, according to the processing method of the present invention, it becomes possible to obtain color images having good image quality and high fastness using short processing time.

EXAMPLE 5

Color photographic papers were prepared in the same manner as in Example 4 but replacing magenta coupler ExM in the third layer (magenta-coloring layer) in Example 4 by an equimolar amount of the compounds indicated in Table 5. As color developing agents the compounds indicated in Table 5 were used. The color photographic papers thus prepared were processed and evaluated in the same manner as in Example 4.

In order to measure the degree of the stain formation of the above processed photographic paper after storage at 80° C., 60% RH for 12 days, the increment of the minimum density ($\Delta D_B$) after storage was determined.

Of the results obtained the density after fading (FD) and the above $\Delta D_B$ of the magenta color images are shown in Table 5.

TABLE 5

| Sample No. | Color Developing Agent | Magenta Coupler M-1 $\Delta D_B$ | M-1 FD | M-4 $\Delta D_B$ | M-4 FD | ExM $\Delta D_B$ | ExM FD |
|---|---|---|---|---|---|---|---|
| 51 (Comparison) | 4-Amino-3-methyl-N-ethyl-N-[β-(methanesulfonamido)-ethyl]-aniline.3/2 sulfate.monohydrate | 0.45 | 55 | 0.30 | 64 | 0.17 | 83 |
| 52 (Comparison) | 4-Amino-3-methyl-N-ethyl-N-(β-hydroxyethyl)-aniline.sulfate | 0.45 | 33 | 0.25 | 37 | 0.09 | 50 |
| 53 (Invention) | 4-Amino-3-methyl-N-ethyl-N-(3-hydroxypropyl)-aniline.2.p-toluenesulfonic acid | 0.45 | 59 | 0.24 | 65 | 0.09 | 85 |
| 54 (Invention) | 4-Amino-3-methyl-N-ethyl-N-(4-hydroxybutyl)-aniline.naphthalene-1,5-diphosphonic acid | 0.46 | 59 | 0.24 | 67 | 0.09 | 90 |

It is clear from the results in Table 5 that light fastness of the magenta color image is better with the color developing agents used in the present invention than with the comparison ones.

It is also shown that Couplers M-4 and ExM provide better light fastness, with the latter being still better than the former.

It has also been shown that the stain formation after storage at 80° C., 60% RH for 12 days can be inhibited in the present invention.

Preferably, Couplers M-4 and ExM are used for obtaining better results in the prevention of the stain formation, with the latter coupler being still better than the former one.

EXAMPLE 6

Color photographic papers were prepared in the same manner as in Example 5 but replacing the magenta coupler in the third layer (magenta-coloring layer) in Example 4 by an equimolar amount of the compounds indicated in Table 6. The color photographic materials so prepared were processed and evaluated in just the same manner as in Example 5. The results are shown in Table 6.

TABLE 6

| | | Magenta Coupler | | | | | | | | | | | |
|---|---|---|---|---|---|---|---|---|---|---|---|---|---|
| | | M-5 | | M-7 | | M-9 | | M-13 | | M-22 | | M-26 | |
| Sample No. | Color Developing Agent | $\Delta D_B$ | FD | $\Delta D_B$ | FD | $\Delta D_B$ | FD | $\Delta D_B$ | FD | $\Delta D_B$ | FD | $\Delta D_B$ | FD |
| Comparison | 4-Amino-3-methyl-N-ethyl-N-[β-(methanesulfonamido)-ethyl]aniline.3/2 sulfate. monohydrate | 0.32 | 63 | 0.34 | 64 | 0.18 | 87 | 0.18 | 89 | 0.22 | 82 | 0.24 | 78 |
| Comparison | 4-Amino-3-methyl-N-ethyl-N-(β-hydroxyethyl)aniline. sulfate | 0.26 | 35 | 0.28 | 33 | 0.10 | 51 | 0.10 | 52 | 0.14 | 45 | 0.15 | 44 |
| Invention | 4-Amino-3-methyl-N-ethyl-N-(3-hydroxypropyl)-aniline.2.p-toluene-sulfonic acid | 0.24 | 66 | 0.25 | 66 | 0.09 | 88 | 0.09 | 90 | 0.13 | 83 | 0.14 | 80 |
| Invention | 4-Amino-3-methyl-N-ethyl-N-(4-hydroxybutyl)aniline. 2.p-toluenesulfonic acid | 0.24 | 68 | 0.26 | 67 | 0.09 | 92 | 0.09 | 92 | 0.13 | 85 | 0.13 | 81 |

It is clear from the results in Table 6 that the excellent light fastness can be obtained and the stain formation after storage under wet heat conditions can be inhibited when the color developing agents disclosed in the present invention are used and at the same time a 2-equivalent coupler having an anion-releasing group introduced at a coupling position, preferably a pyrazoloazole coupler is used as a magenta coupler.

While the invention has been described in detail and with reference to specific embodiments thereof, it will be apparent to one skilled in the art that various changes and modifications can be made therein without departing from the spirit and scope thereof.

What is claimed is:

1. A method for developing an imagewise exposed silver halide color photographic material which comprises developing a color photographic material containing silver halide grains comprising (i) substantially no silver iodide and (ii) at least about 95 mol % silver chloride with a developer comprising (i) substantially no benzyl alcohol and (ii) a p-phenylenediamine derivative represented by the formula (I):

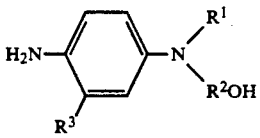

(I)

wherein $R^1$ and $R^3$ each represents an alkyl group having from 1 to 4 carbon atoms and $R^2$ represents a straight chain or branched alkylene group having 3 or 4 carbon atoms, wherein said developing is for a period of time of 30 seconds or less and wherein developing is carried out at a temperature of about 30° to 50° C.

2. A method for developing an imagewise exposed silver halide color photographic material which comprises developing a color photographic material containing silver halide grains comprising (i) substantially no silver iodide and (ii) at least about 80 mol % silver chloride with a developer comprising (i) substantially no benzyl alcohol and (ii) a p-phenylenediamine derivative represented by the formula (I):

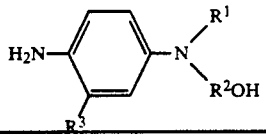

(I)

wherein $R^1$ and $R_3$ each represents an alkyl group having from 1 to 4 carbon atoms and $R_2$ represents a straight chain or branched alkylene group having 4 carbon atoms and wherein said developing is for a period of time of 30 seconds or less and wherein developing is carried out at a temperature of about 30° to 50° C.

3. A method according to claim 1, wherein said period of time is 20 seconds or less.

4. A method according to claim 1, wherein said p-phenylenediamine derivative is present at a concentration of about 0.2 to 60 g per liter of said developer.

5. A method according to claim 1, wherein said p-phenylenediamine derivative is present at a concentration of about 1 to 30 g per liter of said developer.

6. A method according to claim 1, wherein said developing is carried out at a pH of about 9 to 12.

7. A method according to claim 1, wherein said developing is carried out at a pH of about 9 to 11.

8. A method according to claim 1, wherein said color photographic material has a green-sensitive silver halide layer containing a 5-pyrazolone magenta coupler having an anion-releasing group introduced at a coupling position or a pyrazoloazole magenta coupler.

9. A method according to claim 1, wherein said benzyl alcohol is present in said developer in an amount of less than about 0.5 ml/liter.

10. A method according to claim 1, wherein no benzyl alcohol is present in said developer.

11. A method according to claim 1, wherein said color developer comprises bromide ion in an amount of $0.5\times10^{-5}$ to $1\times10^{-3}$ mol/l.

12. A method according to claim 11, wherein said color developer comprises bromide ion in an amount of $3\times10^{-5}$ to $5\times10^{-4}$ mol/l.

* * * * *